US007722145B2

(12) United States Patent
Kubota

(10) Patent No.: US 7,722,145 B2
(45) Date of Patent: May 25, 2010

(54) INK JET HEAD DRIVING APPARATUS AND INK JET HEAD DRIVING METHOD

(75) Inventor: Atsushi Kubota, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 338 days.

(21) Appl. No.: 11/617,033

(22) Filed: Dec. 28, 2006

(65) Prior Publication Data

US 2008/0158276 A1 Jul. 3, 2008

(51) Int. Cl.
*B41J 29/38* (2006.01)

(52) U.S. Cl. ..... 347/12

(58) Field of Classification Search ..... 347/12
See application file for complete search history.

(56) References Cited

U.S. PATENT DOCUMENTS

| | | | | |
|---|---|---|---|---|
| 6,431,685 | B1 * | 8/2002 | Misumi | 347/57 |
| 2004/0070641 | A1 * | 4/2004 | Inoue | 347/19 |
| 2006/0197791 | A1 | 9/2006 | Iriguchi et al. | |

FOREIGN PATENT DOCUMENTS

| | | |
|---|---|---|
| CN | 1400927 | 3/2003 |
| EP | 1 535 746 A1 | 6/2005 |
| JP | 2003-170588 | 6/2003 |
| JP | 2005-096210 | 4/2005 |
| JP | 2005-153378 | 6/2005 |
| JP | 2006-198902 | 8/2006 |

OTHER PUBLICATIONS

Chinese Office Action for 200710307093.02 mailed on Sep. 18, 2009.

* cited by examiner

*Primary Examiner*—Julian D Huffman
(74) *Attorney, Agent, or Firm*—Turocy & Watson, LLP

(57) ABSTRACT

An ink jet head driving apparatus for driving an ink jet head having plural nozzles to discharge supplied ink includes actuators provided correspondingly to the respective nozzles and to cause corresponding amounts of ink to be discharged from the nozzles by drive signals, a storage unit to store correction data for equalizing the ink discharge amounts from the respective nozzles, a selection unit to select one drive signal from the plural drive signals based on the correction data, and a drive unit to output the selected drive signal to the actuator at a specified timing, in which the nozzles of the ink jet head are classified into plural groups correspondingly to ink discharge amount characteristics of the nozzles, and the correction data is determined for each of the plural classified groups of the nozzles.

16 Claims, 21 Drawing Sheets

INK JET HEAD DRIVING APPARATUS AND INK JET HEAD DRIVING METHOD

BACKGROUND OF THE INVENTION

1. Field of the Invention

The present invention relates to a technique to control an ink jet head of an ink jet printer, and particularly to a technique to correct, in an ink jet head including many nozzles, variations in the amounts of droplets discharged from the respective nozzles.

2. Description of the Related Art

An ink jet printer includes an ink jet head. The ink jet head distributes ink supplied from an ink tank into plural pressure chambers, causes pressure to be selectively generated in the respective pressure chambers, and discharges ink droplets from nozzles communicating with the respective pressure chambers. The ink jet printer drives the ink jet head and a recording medium relatively, discharges the ink droplets from the ink jet head, and records an image on the recording medium.

With respect to the ink jet head, according to the discharge method of ink droplets, a Piezo system, a thermal system, an electrostatic system or the like is known.

In recent years, a printer including an ink jet head in which plural nozzles are provided in a line has been developed. Such a printer has a merit that high speed printing can be performed. On the other hand, when the ink jet head is elongated, it is difficult to keep the amounts of droplets as the discharge characteristics of the respective droplets to be uniform by reason of manufacture or material properties. Thus, there is a problem that uneven density occurs in a recorded image and the picture quality is liable to be degraded.

In order to solve the foregoing problem, various techniques are proposed.

A switching device is provided which drives actuator elements arranged correspondingly to plural nozzles individually. The waveforms of voltages supplied to the actuator elements are adjusted, so that variations in the actuator elements are eliminated, and the volumes of discharged ink droplets are made uniform with respect to the respective nozzles (JP-A-2003-170588).

In an ink jet recording apparatus to form an image based on print data, the discharge pattern of ink discharge is selected from plural waveform patterns and printing is performed (JP-A-2005-153378).

Print conditions are previously determined, which include the presence or absence of variation correction of each nozzle, the presence or absence of variation correction of average discharge characteristics of respective groups when plural liquid droplet discharge characteristics are divided into plural groups, and the presence or absence of gradation printing. Further, plural drive waveforms for driving the respective driving elements are determined according to the print conditions. Waveform application means selects the drive waveform according to the print conditions and applies it to the driving element. By this, a reduction in picture quality due to variations in discharge characteristics of droplet nozzles is prevented (JP-A-2006-198902).

BRIEF SUMMARY OF THE INVENTION

An ink jet head driving apparatus according to a first aspect of the invention is an ink jet head driving apparatus for driving an ink jet head having plural nozzles to discharge supplied ink, and includes actuators provided correspondingly to the respective nozzles and to cause corresponding amounts of ink to be discharged from the nozzles by drive signals, a storage unit configured to store correction data for equalizing the ink discharge amounts from the respective nozzles, a selection unit configured to select one drive signal from the plural drive signals based on the correction data, and a drive unit configured to output the selected drive signal to the actuator at a specified timing, in which the nozzles of the ink jet head are classified into plural groups correspondingly to ink discharge amount characteristics of the nozzles, and the correction data is determined for each of the plural classified groups of the nozzles.

An ink jet head driving apparatus according to a second aspect of the invention is an ink jet head driving apparatus for driving an ink jet head having plural nozzles to discharge supplied ink, and includes a nozzle driving device for each of plural blocks obtained by dividing the ink jet head, in which the nozzle driving device includes actuators provided correspondingly to the respective nozzles and to cause corresponding amounts of ink to be discharged from the nozzles by drive signals, a storage unit configured to store correction data for the respective blocks and for equalizing the ink discharge amounts from the respective nozzles, a selection unit configured to select one drive signal from the plural drive signals based on the correction data, and a drive unit configured to output the selected drive signal to the actuator at a specified timing, and in which the nozzles in the block are classified into plural groups correspondingly to ink discharge amount characteristics of the nozzles, and the correction data is determined for each of the plural classified groups of the nozzles.

An ink jet head driving method according to a third aspect of the invention is an ink jet head driving method for an ink jet head driving apparatus including an ink jet head having plural nozzles to discharge supplied ink, and actuators provided correspondingly to the respective nozzles and to cause corresponding amounts of ink to be discharged from the nozzles by drive signals, and includes classifying the nozzles of the ink jet head into plural groups correspondingly to ink discharge amount characteristics of the nozzles, determining, for the respective plural groups of the nozzles, correction data for equalizing the ink discharge amounts from the respective nozzles, storing the correction data, selecting one drive signal from the plural drive signals based on the correction data, and outputting the selected drive signal to the actuator at a specified timing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

FIRST EMBODIMENT

A first embodiment of the invention will be described with reference to the drawings.

Figure 1:
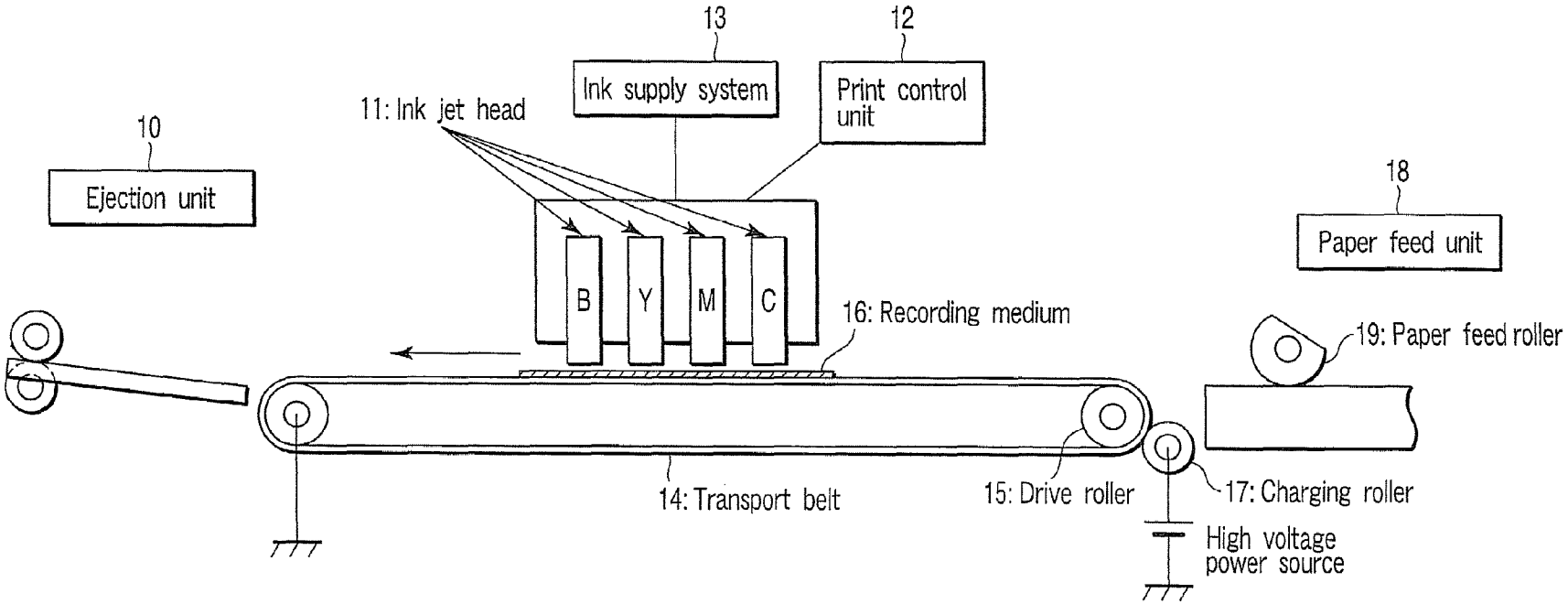
FIG. 1 is a view showing a printing apparatus including a line ink jet head.

FIG. 1 shows a printing apparatus including a line ink jet head.

The printing apparatus includes an ejection unit 10, an ink jet head 11, a print control unit 12, an ink supply system 13, a transport belt 14, a drive roller 15, a charging roller 17, a paper feed unit 18 and a paper feed roller 19.

The print control unit 12 controls the print operation of the ink jet head 11. The charging roller 17 charges the transport belt 14 to cause a recording medium 16 to be adsorbed to the transport belt 14. The paper feed roller 19 sends out the recording medium 16 from the paper feed unit 18.

The recording medium 16 is taken out by the paper feed roller 19 of the paper feed unit 18, is adsorbed to the transport belt 14, and then is transported by the transport belt 14. At this time, previously created print data is transferred to the ink jet head 11. The ink jet head 11 controls the print operation based on the print data, and records an image on the recording medium 16. The recorded recording medium 16 is ejected to the ejection unit 10.

Figure 2:
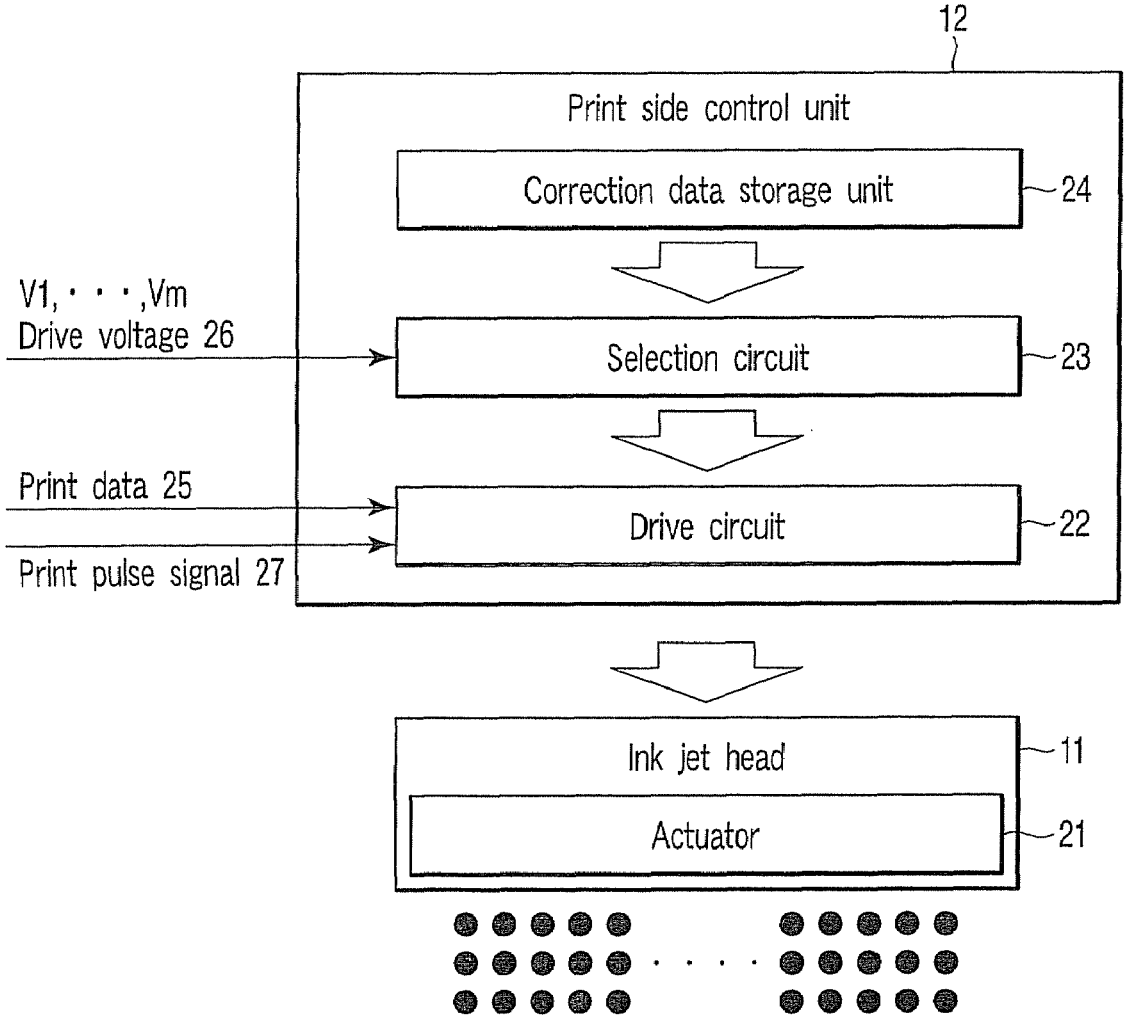
FIG. 2 is a view showing a structure of an ink jet head driving circuit.

FIG. 2 is a view showing a structure of an ink jet head driving circuit of the print control unit 12.

The ink jet head 11 includes actuators 21. The actuators 21 are provided correspondingly to the respective nozzles of the ink jet head 11, and the number thereof is N equal to the number N of the nozzles. The actuators 21 are driven so that the amounts of droplets discharged from the nozzles are controlled.

The print control unit 12 includes a driving circuit 22, a selection circuit 23, and a correction data storage unit 24. The driving circuit 22 drives the actuator 21 of the ink jet head 11. The correction data storage unit 24 stores correction data D for the respective actuators.

Various signals for controlling the printing are inputted to the respective units of the print control unit 12. Drive voltages 26 are inputted to the selection circuit 23. Print data 25 and a print pulse signal 27 are inputted to the driving circuit 22.

The drive voltages 26 are m kinds (V1-Vm) of drive voltages for driving the actuators 21 of the ink jet head 11. The print data 25 is the data for driving the actuators 21 of the ink jet head 11 to discharge ink. The print pulse signal 27 is the signal for adjusting the print timing, and the actuator 21 of the ink jet head 11 is driven in accordance with this print pulse signal 27.

The correction data D stored in the correction data storage unit 24 and corresponding to the respective actuators 21 of the ink jet head 11 are read out and are supplied to the selection circuit 23. In the selection circuit 23, in accordance with the correction data D of the respective actuators 21, the one drive voltage 26 of the voltages of V1-Vm of the drive voltages 26 is selected. The selected drive voltage is supplied to the actuator 21 at the timing of the print pulse signal 27.

Figure 3:
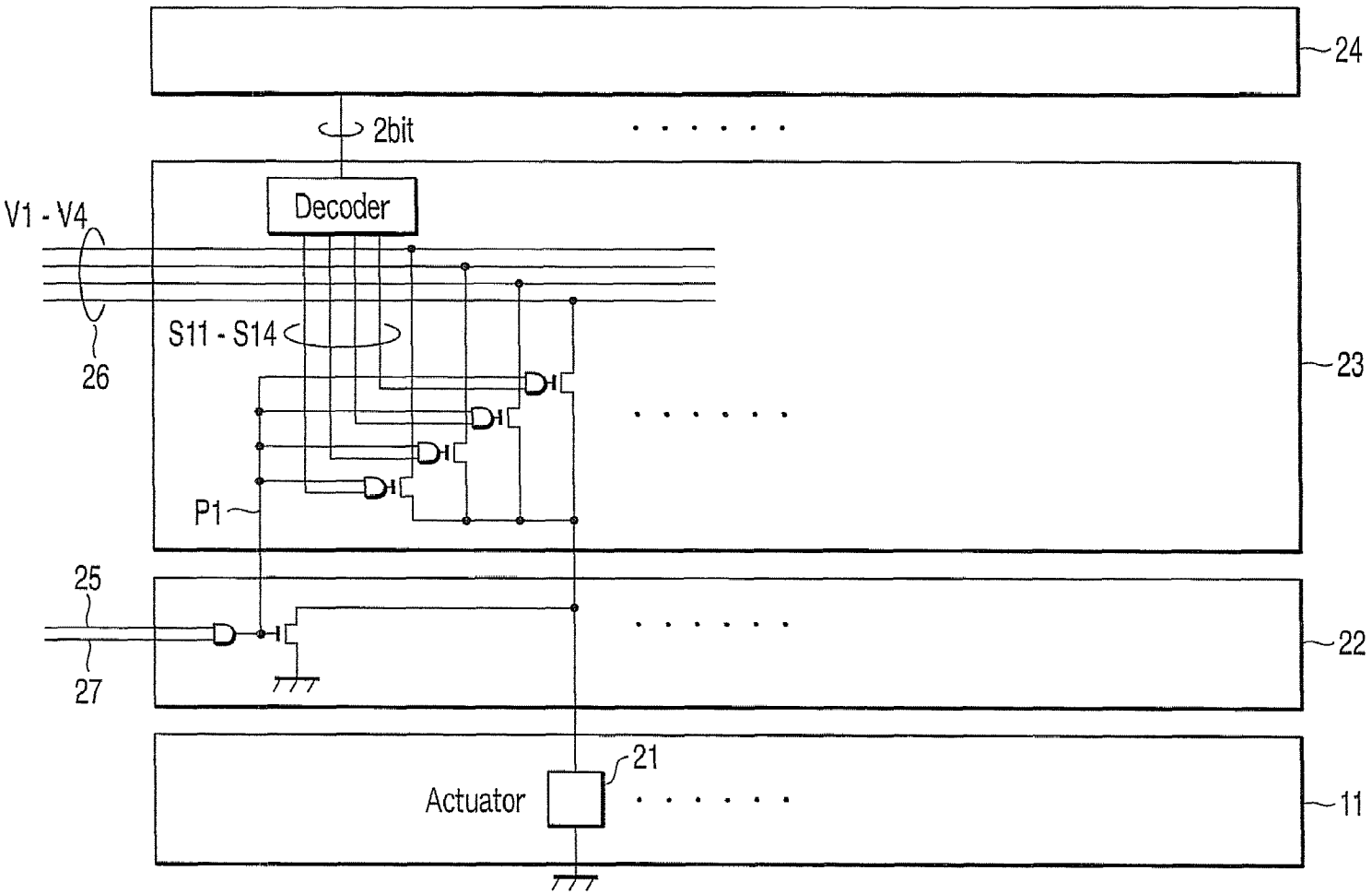
FIG. 3 is a view showing a detailed structure of the ink jet head driving circuit.

FIG. 3 shows a detailed structure of the ink jet head driving circuit. The n actuators 21, the n driving circuits 22, the n selection circuits 23, and the n correction data storage units 24 are prepared, where n is equal to the number of the actuators. FIG. 3 shows the circuit portion for one actuator.

In the correction data storage unit 24, the correction data D for the actuator 21 is stored in the form of information of, for example, 2 bits. The 2-bit information is read out from the correction data storage unit 24, is supplied to the selection circuit 23, and is inputted to the decoder. Only one of four selection signals S11-S14 outputted from the decoder becomes "H" in accordance with the correction data D.

The print data 25 serially transmitted from the outside is decomposed into print data for the respective actuators 21 by a shift register (not shown) of the driving circuit 22. The print pulse signal 27 and the print data 26 decomposed into the data for the respective actuators 21 generate a drive pulse P1 through an AND circuit in the driving circuit 22. The drive pulse P1 and the selection signals S11-S14 are connected to a switching element through AND circuits of the selection circuit 23. This switching element is connected so as to select one of the drive voltages (V1-V4) 26 supplied from the outside of the selection circuit 23.

As a result, the drive voltage 26 selected by the decoder based on the correction data D is supplied to the drive circuit 22 at the timing of the drive pulse P1. The supplied voltage is directly supplied to the actuator 21 and is also supplied to the discharge circuit at the same time. In this way, according to the ink jet head driving circuit, the voltage can be selectively changed in accordance with the correction data D.

Incidentally, the pulse width of the print pulse signal 27 has only to be set so that the largest amount of ink droplet is discharged when ink is discharged.

Next, a creation method of the correction data D will be described.

The correction data D is obtained correspondingly to the ink discharge amount at the time when the actuator 21 of the ink jet head 11 is driven. As a method of obtaining the discharge amount of ink, there is a method of using a print dot diameter at the time when an image is formed with single dots on the recording medium 16, a line width of an image at the time when the image is formed with continuous dots by scanning the recording medium 16 and the ink jet head 11 relatively, volume calculation by an image pickup and image processing of an ink droplet discharged from the ink jet head 11, or the like. Hereinafter, as an example, a method of obtaining a correction amount in accordance with a dot diameter will be described.

Figure 4:
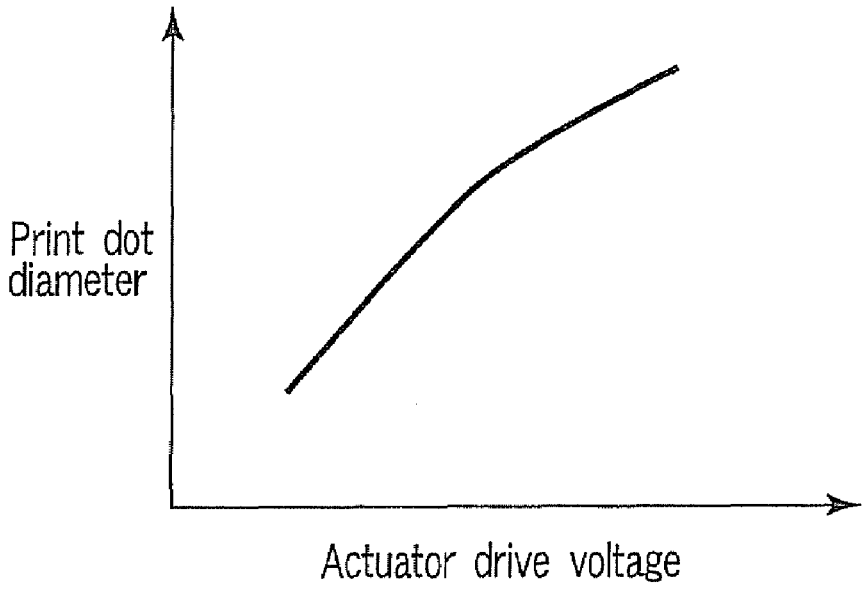
FIG. 4 is a view showing a relation between a print dot diameter and an actuator drive voltage.

FIG. 4 shows a relation between a print dot diameter and an actuator drive voltage. As the drive voltage becomes high, the amount of discharged ink droplet becomes large, and as a result, the print dot diameter becomes large.

Figure 5:
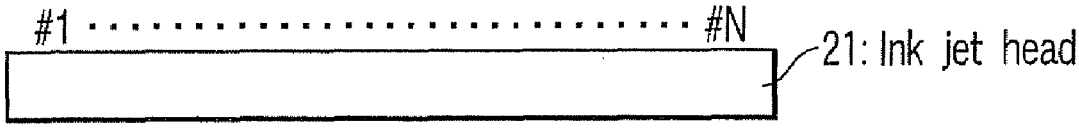
FIG. 5 is a view showing nozzle positions of a head.

FIG. 5 shows nozzle positions of the head. In the drawing, N nozzles are provided. The nozzle positions are denoted by #1, . . . , #N.

Figure 6:
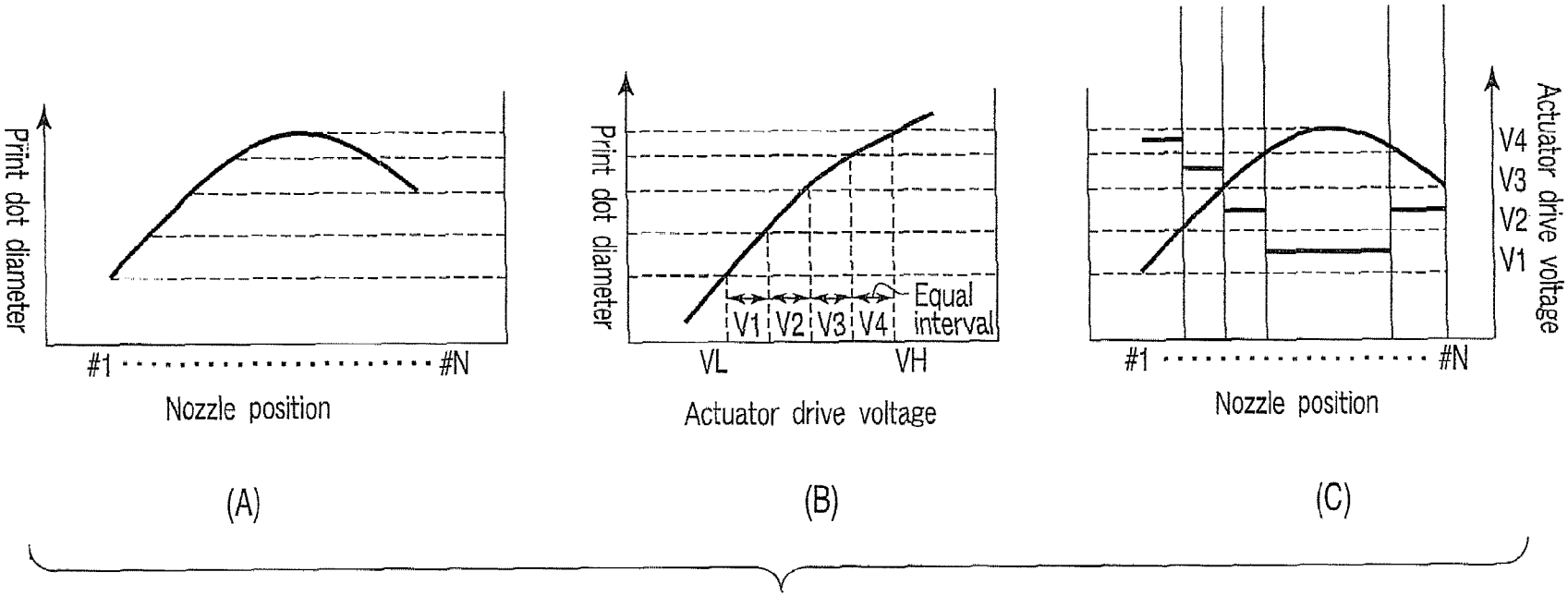
FIG. 6 is a view for explaining a creation method of correction data.

FIG. 6(A) shows measurement results of print dot diameters corresponding to the nozzle positions of the ink jet head 11. This drawing shows an example in which all the actuators 21 of the ink jet head 11 are driven to form an image and the dot diameters are measured.

Next, the maximum value and the minimum value of the dot diameter actual measurement results are obtained and they are divided into groups. With respect to the number of the divided groups at this time, since the correction data D explained in FIG. 3 has 2 bits in the example, a description will be given to an example in which division into four parts is performed.

In FIG. 6(B), the relation between the print dot diameter and the actuator drive voltage explained in FIG. 4 is arranged next to FIG. 6(A) and is made to correspond thereto. An actuator drive voltage VH of a portion where the print dot diameter becomes the maximum value and an actuator drive voltage VL of a portion where the print dot diameter becomes the minimum value are obtained. The voltage of (VH-VL) is divided into four equal parts and is divided into four groups. The center voltages of the respective groups are set to V1, V2, V3 and V4 in ascending order.

Based on the measurement results of the print dot diameters, an actuator drive voltage is determined from the grouped voltages V1-V4. A portion belonging to a group in which the print dot diameter is large is given the actuator drive voltage V1, and a portion belonging to a group in which the print dot diameter is small is given the actuator drive voltage V4. FIG. 6(C) shows the relation between the nozzle position and the actuator drive voltage.

As a result, the correction data D is stored in the correction data storage unit 24 such that it is "00"B when the actuator drive voltage is V1, "01"B when the actuator drive voltage is V2, "10"B when the actuator drive voltage is V3, and "11"B when the actuator drive voltage is V4, and the actuator is driven in accordance with this.

Figure 7:
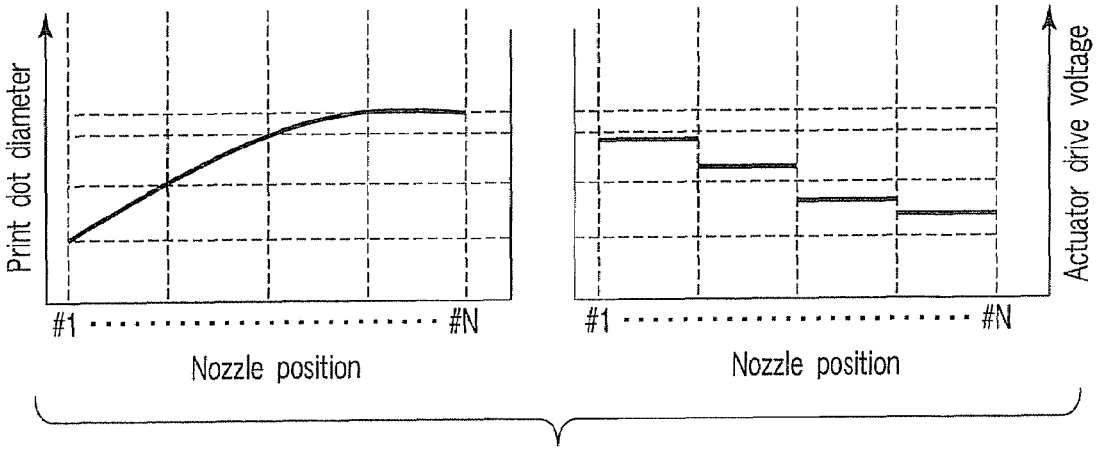
FIG. 7 is a view showing correction data in a case where an ink droplet amount varies smoothly.
Figure 8:
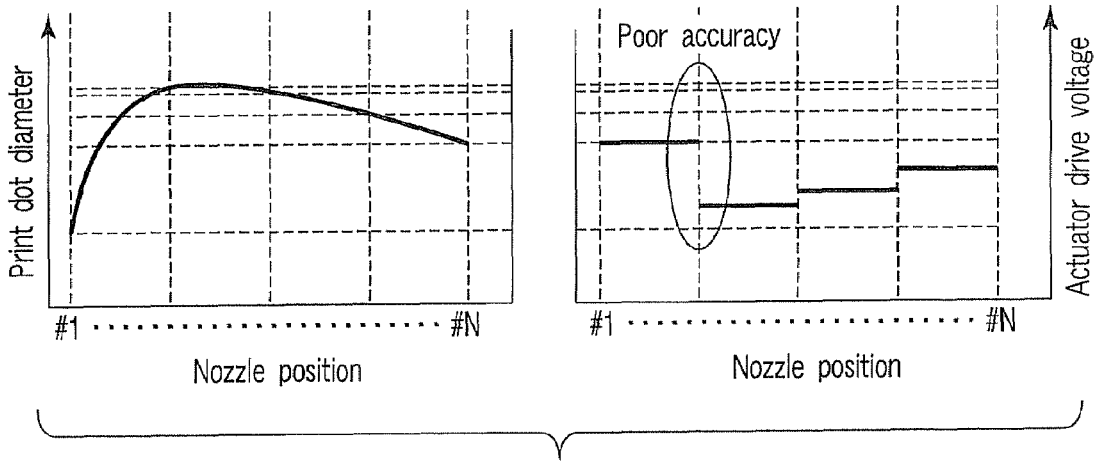
FIG. 8 is a view showing correction data in a case where an ink droplet amount varies abruptly.

Incidentally, as another method, a method is also easily conceivable in which all actuators are divided into plural parts, and the correction data D is created in this divided range. In the application of this method, there is a point to which attention is to be paid. Although this method can deal with the ink jet head 11 having relatively gentle variations in ink droplet amounts, in the case where the change is abrupt, the correction accuracy becomes poor. FIG. 7 shows correction data in the case where the ink droplet amount varies gently, and FIG. 8 shows correction data in the case where the ink droplet amount varies abruptly.

Figure 9:
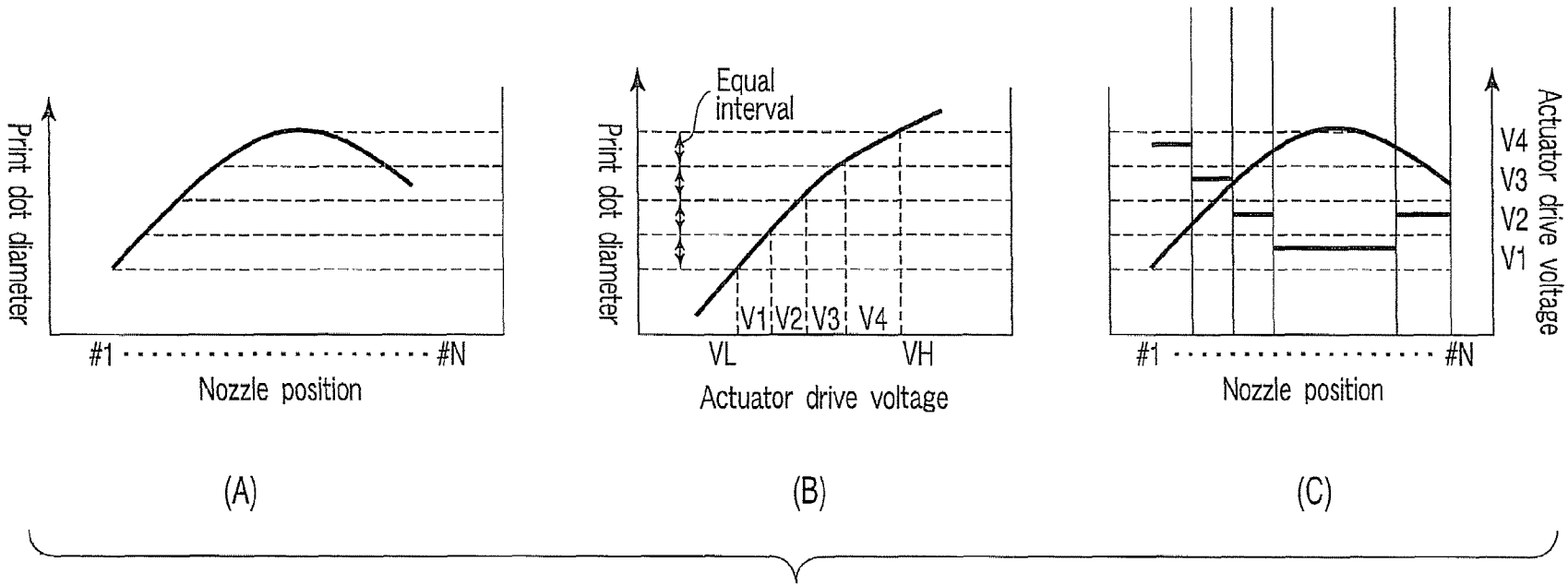
FIG. 9 is a view for explaining a creation method of correction data.

Further, another method will be described. In the above description, with respect to the division of the actuator drive voltages V1-V4, the range between the voltage of the portion where the print dot becomes maximum and the voltage of the portion where the print dot becomes minimum is divided into four equal parts and the correction data D is created. FIG. 9 is a view for explaining the another method.

Since FIG. 9(A) is the same as FIG. 6(A), its description will be omitted. Next, the maximum value and the minimum value of dot diameter actual measurement results are obtained and they are divided into groups. With respect to the number of the divided groups at this time, since the correction data D explained in FIG. 3 has 2 bits in the example, a description will be given to an example in which division into four parts is performed.

In FIG. 9(B), the relation between the print dot diameter and the actuator drive voltage explained in FIG. 4 is arranged next to FIG. 9(A) and is made to correspond thereto. An actuator drive voltage VH of a portion where the print dot diameter becomes the maximum value and an actuator drive voltage VL of a portion where the print dot diameter becomes minimum value are obtained.

The range between the maximum diameter and the minimum diameter of the print dot diameter is divided into four equal parts and is divided into four groups. The center voltages of the respective groups are set to be V1, V2, V3 and V4 in ascending order.

Based on the measurement result of the print dot diameter, an actuator drive voltage is determined from the grouped voltages V1-V4. A portion belonging to a group in which the print dot diameter is large is given the actuator drive voltage V1, and a portion belonging to a group in which the print dot diameter is small is given the actuator drive voltage V4. FIG. 9(C) shows the relation between the nozzle position and the actuator drive voltage.

As a result, the correction data D is stored in the correction data storage unit 24 such that it is "00"B when the actuator drive voltage is V1, "01"B when the actuator drive voltage is V2, "10"B when the actuator drive voltage is V3, and "11B" when the actuator drive voltage is V4, and the actuator is driven in accordance with this.

Incidentally, with respect to the division number in the above, since the correction data of FIG. 3 has 2 bits, the division into four parts is performed, however, when the correction data D has 3 bits, division into eight parts may be performed. However, when the division number is made large, the amount of the correction data D is also increased in accordance with that, and therefore, it is desirable that the data has approximately 2 bits or 3 bits.

Besides, in the above description, the example has been described in which the variations in the ink droplet amounts are corrected by using the print dot diameter. However, no limitation is made to this example, and it can be similarly performed by measuring the line width of a straight line formed with continuous ink droplets discharged from the respective actuators.

Further, the ink droplet directly discharged from the ink jet head 11 is stroboscopically photographed to obtain the volume of the ink droplet amount, and the variations in the ink droplet amounts may be obtained based on this measurement.

Further, it is also possible to adjust the correction data D while printed dots are measured.

Figure 10:
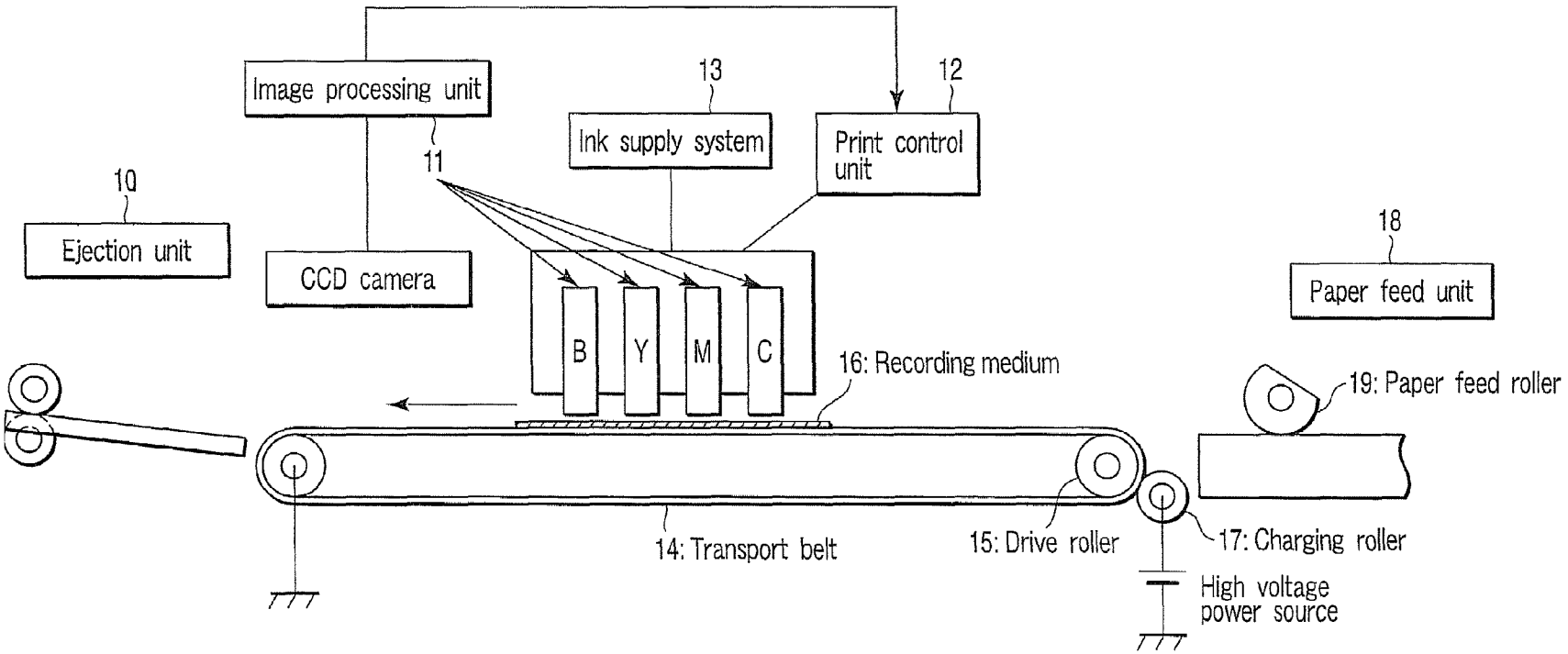
FIG. 10 is a view showing a printing apparatus in which printing results are photographed with a CCD camera and dot diameters are measured.

FIG. 10 shows a printing apparatus in which a print result is photographed by a CCD camera, and dot diameters thereof are measured. An image read by the CCD is supplied to an image processing unit. The image processing unit performs a correction such as a shading correction and performs binarization. Based on this image processing result, the image processing unit measures the diameters of dots formed by ink droplets discharged from respective actuators. The dot diameters of the measurement results are supplied to a print control unit 12. The print control unit 12 creates correction data D and adjusts actuator drive voltages.

Figure 11:
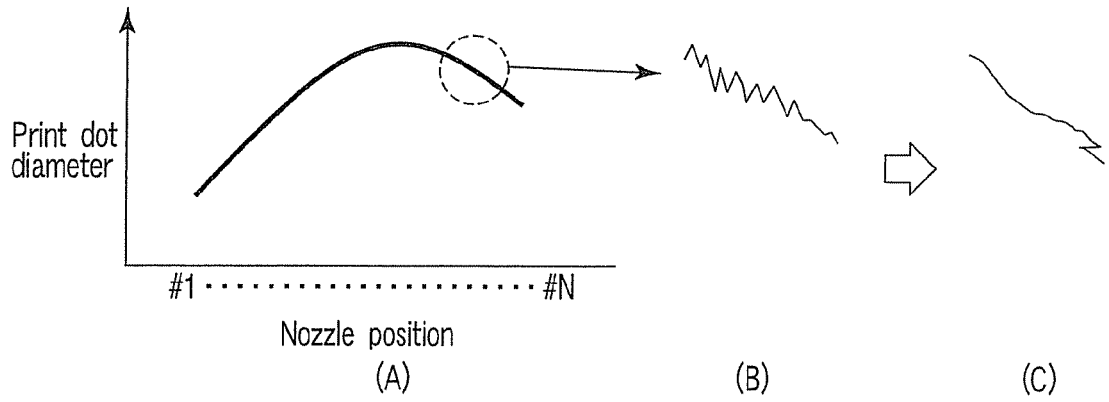
FIG. 11 is a view for explaining a creation method of correction data.

FIG. 11(A) shows the measurement result of print dot diameters corresponding to nozzle positions of an ink jet head 11.

Two kinds of variations exist in a curved line of the measurement result. The first variation is a variation occurring in a nozzle array direction of a line head and having a relatively low frequency component. A second variation is a variation caused by the variation of adjacent actuators and having a relatively high frequency component.

Because of the second variation, there is a case where when correction is performed for each actuator, unevenness in discharge volume becomes noticeable by contraries. In FIG. 11(B), a part of FIG. 11(A), that is, a portion encircled by a circle is enlarged and shown. At a boundary portion produced when grouping is performed, voltages to drive adjacent actuators are alternately changed. When this portion performs image formation, a noticeable result is obtained. Then, the print dot diameters are movement-averaged in the nozzle position direction, and the correction data D is created based on this result. By performing the processing in this way, as shown in FIG. 11(C), the curved line is smoothed, and unevenness of an image can be made unnoticeable.

SECOND EMBODIMENT

In a second embodiment, the same portions as those of the first embodiment are denoted by the same symbols and their description will be omitted.

Figure 12:
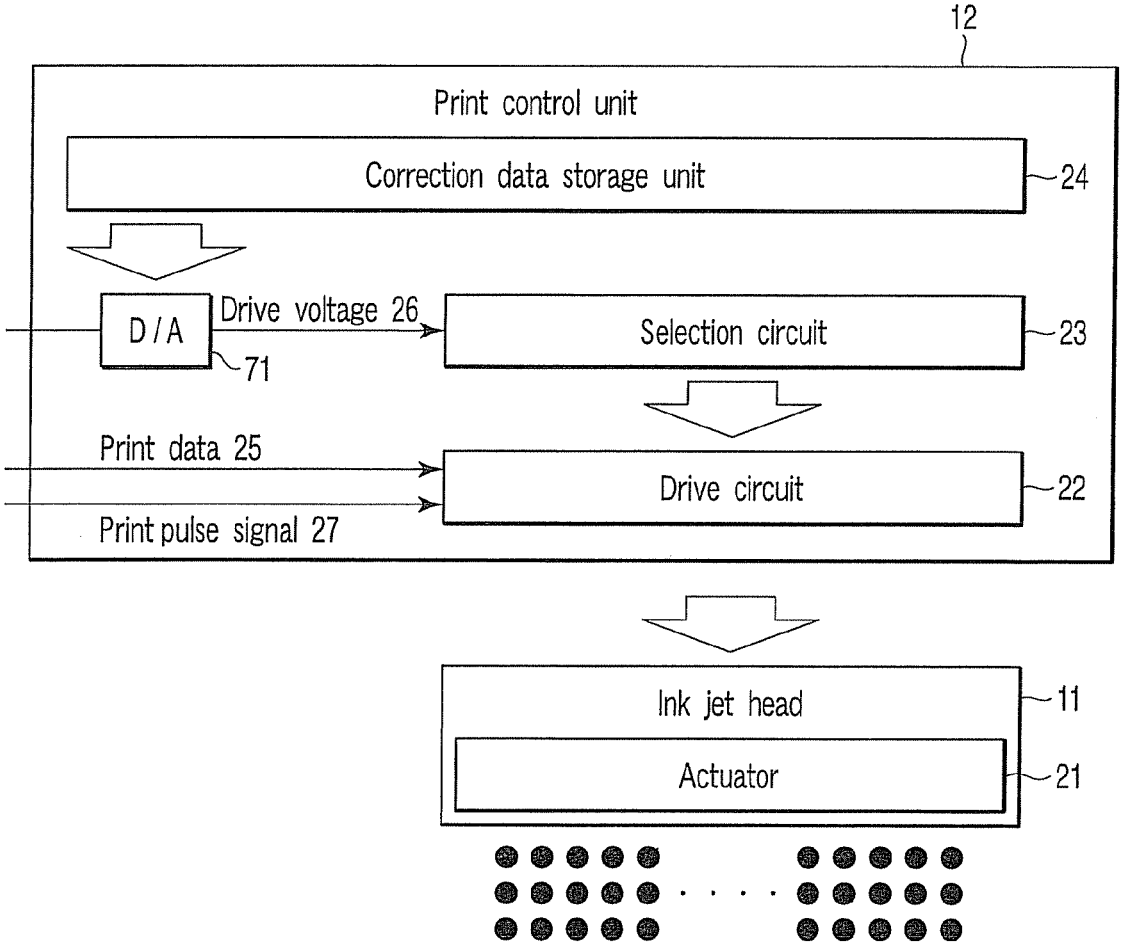
FIG. 12 is a view showing a structure of an ink jet head driving circuit of a print control unit.

FIG. 12 is a view showing a structure of an ink jet head driving circuit of a print control unit 12 according to the second embodiment.

The second embodiment is different from the first embodiment in that a print control unit 12 further includes a D/A converter 71. Since the structure of the other portions is the same as that of FIG. 2, their detailed description will be omitted.

The D/A converter 71 generates plural kinds of actuator drive voltages V1-Vm. The type of the actuator drive voltage generated by the D/A converter 71 is outputted from a correction data storage unit 24.

Figure 13:
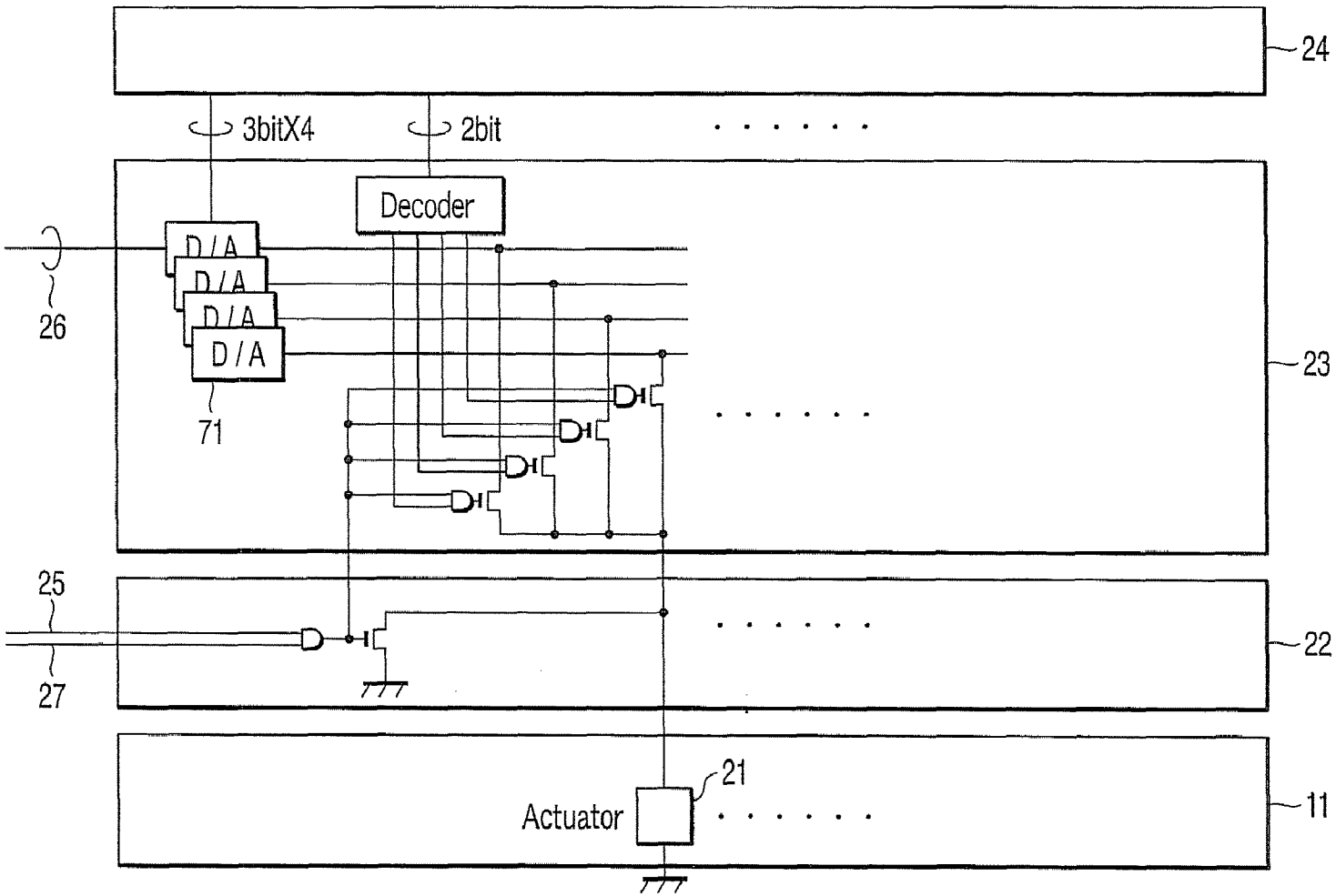
FIG. 13 is a view showing a detailed structure of the ink jet head driving circuit.

FIG. 13 shows a detailed structure of the ink jet head driving circuit according to the second embodiment. A 3-bit designation line for designating the kind of the actuator drive voltage to be generated is provided between the correction data storage unit 24 and the D/A converter 71.

Designation data S of 3-bit information for the D/A converter 71 is stored in the correction data storage unit 24. The 3-bit information is read out from the correction data storage unit 24 and is supplied to the D/A converter 71. In accordance with the designation data S, the D/A converter 71 generates the drive voltage designated by 3 bits. The D/A converter 71 generates four kinds of actuator drive voltages. An actuator drive voltage group selected by the correction data D is selected, and the selected actuator drive voltage group is supplied to a selection circuit 23.

Incidentally, since the operations of the other circuits are similar to those of the first embodiment, their detailed description will be omitted.

Figure 14:
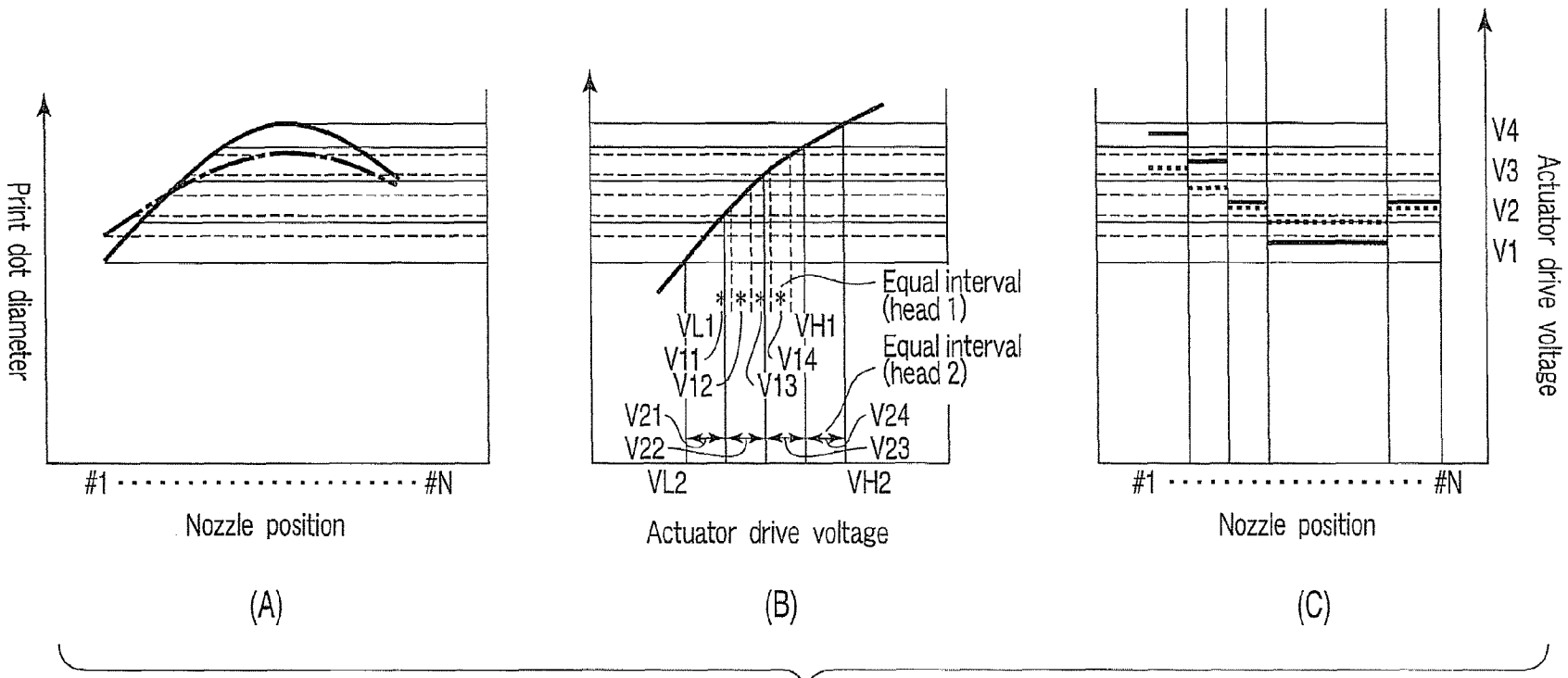
FIG. 14 is a view for explaining a creation method of correction data.

FIG. 14 is a view for explaining a creation method of the correction data according to the second embodiment. FIG. 14(A) shows measurement results of print dot diameters corresponding to nozzle positions of the ink jet head 11. This drawing shows an example in which all the actuators 21 of the ink jet head 11 are driven to form an image and the dot diameters are measured. Incidentally, with respect to the results of the measurement of two heads, the result of the first head is represented by a broken line, and the result of the second head is represented by a solid line. As stated above, the maximum value and the minimum value of the dot diameter measurement results are obtained and they are divided into groups. With respect to the number of the divided groups at this time, since the correction data D explained in FIG. 3 has 2 bits, the division into four parts is performed.

In FIG. 14(B), the relation between the print dot diameter and the actuator drive voltage explained in FIG. 4 is arranged next to FIG. 14(A) and is made to correspond thereto.

An actuator drive voltage VH of a portion where the print dot diameter becomes the maximum value and an actuator drive voltage VL of a portion where the print dot diameter becomes the minimum value are obtained. As shown in FIG. 14(A), since the broken line (first head) and the solid line (second head) are different from each other, the actuator drive voltages VL and VH are respectively different from each other.

With respect to the broken line (first head), the actuator drive voltage of the portion where the print dot diameter becomes the maximum value is made VH1, and the actuator drive voltage of the portion where the print dot diameter becomes the minimum value is made VL1. With respect to the solid line (second head), the actuator drive voltage of the portion where the print dot diameter becomes the maximum value is made VH2, and the actuator drive voltage of the portion where the print dot diameter becomes the minimum value is made VL2.

With respect to each of the broken line (first head) and the solid line (second head), the voltage is divided into four equal parts and is divided into four groups. Center voltages of the groups of the broken line (first head) are made V11, V12, V13 and V14 in ascending order. Center voltages of the groups of the solid line (second head) are made V21, V22, V23 and V24 in ascending order.

Based on the measurement result of the print dot diameter, an actuator drive voltage is determined from the grouped voltages V11-V14 and V21-V24. In the broken line (first head), a portion where the print dot diameter is large is given the actuator drive voltage V11, and a portion where the print dot diameter is small is given the actuator drive voltage V14. In the solid line (second head), a portion where the print dot diameter is large is given the actuator drive voltage V21, and a portion where the print dot diameter is small is given the actuator drive voltage V24.

FIG. 14(C) shows the relation between the nozzle position and the actuator drive voltage. The actuators are driven by the actuator drive voltages indicated by the broken line (first head) and the solid line (second head). The actuator drive voltages V11-V14 and V21-V24 different from each other at this time are respectively stored in the D/A converter 71. When correction is performed, the designation data S corresponding to the actuator drive voltage is set in the D/A converter 71, and V11-V14 and V21-V24 are generated. Incidentally, with respect to the correction of each of the actuators, the readout is performed from the correction data storage unit 24 similarly to the case explained in FIG. 5 and the driving is performed in accordance with the actuator drive voltage.

As described above, since the D/A converter 71 is provided and the actuator drive voltage can be adjusted according to the characteristic of the head, even if the actuator drive voltage varies for each head, the adjustment can be performed.

Incidentally, in the invention, although the example has been described in which the actuator drive voltage is divided, a system in which the print dot diameter is divided may be adopted.

THIRD EMBODIMENT

A third embodiment is different from the first embodiment in a creation method of correction data D. Accordingly, the same portions as those of the first embodiment are denoted by the same symbols and their detailed description will be omitted.

In the first embodiment, the correction data D is determined from the actuator drive voltage VH of the portion where the print dot diameter becomes the maximum value and the actuator drive voltage VL of the portion where the print dot diameter becomes the minimum value. However, the correction accuracy varies according to variations in ink jet heads.

Figure 15:
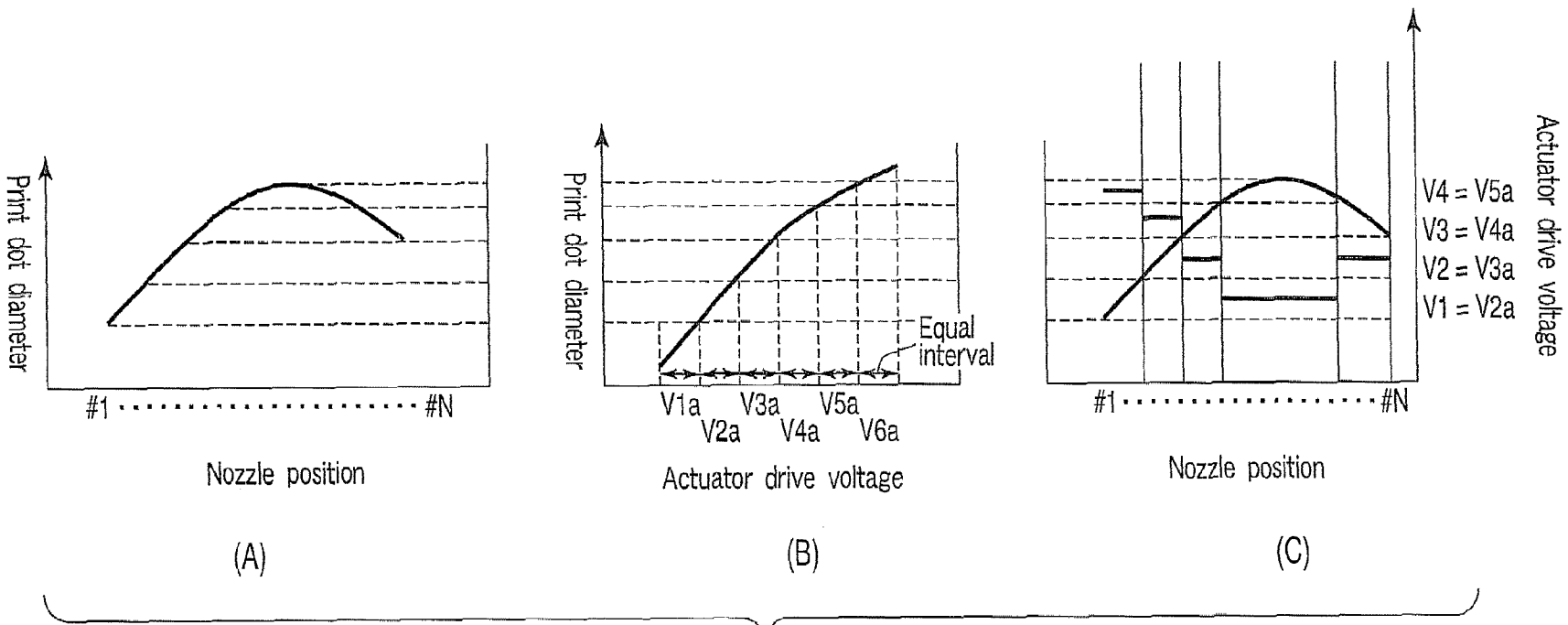
FIG. 15 is a view for explaining a creation method of correction data.

FIG. 15 is a view for explaining the creation method of the correction data D.

FIG. 15(A) shows measurement results of print dot diameters corresponding to nozzle positions of an ink jet head 11. This drawing shows an example in which all actuators 21 of the ink jet head 11 are driven to form an image and dot diameters are measured.

In FIG. 15(B), the relation between the print dot diameter and the actuator drive voltage explained in FIG. 4 is arranged next to FIG. 15(A) and is made to correspond thereto. The actuator drive voltage is previously divided into equal parts. The actuator drive voltage is selected correspondingly to variations in the amounts of ink droplets of the respective actuators 21. Since the correction data D explained in FIG. 3 has 2 bits, the actuator drive voltage is previously divided into four or more parts. For example, it is divided into six parts, and respective divided reference voltages are made V1*a*-V6*a*. The actuator drive voltages V1-V4 are selected from V1*a*-V6*a*.

FIG. 15(C) shows the relation between the nozzle position and the actuator drive voltage. The actuator drive voltage is selected according to the print dot diameter actual measurement result and from the previously divided voltages. From this drawing, V2*a* is selected for V1, V3*a* is selected for V2, V4*a* is selected for V3, and V5*a* is selected for V4. When correction is performed, the selection data D corresponding to this actuator drive voltage is set in a D/A converter 71, and V1-V4 (V2*a*-V5*a*) are generated.

As a result, the correction data D is stored in the correction data storage unit 24 such that it is "00"B when the actuator drive voltage is V1, "01"B when the actuator drive voltage is V2, "10"B when the actuator drive voltage is V3, and "11"B when the actuator drive voltage is V4. The actuator is driven in accordance with the correction data D.

Figure 16:
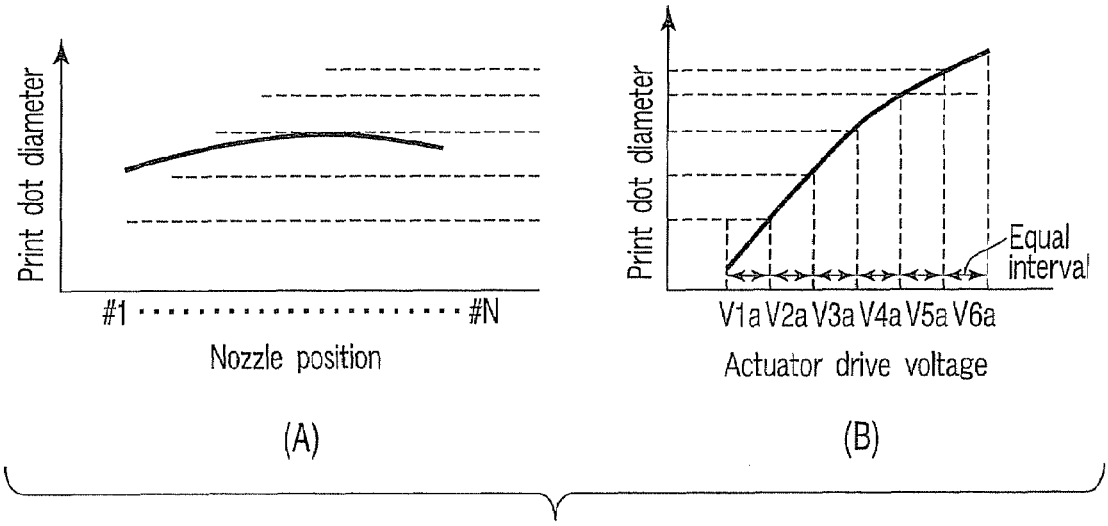
FIG. 16 is a view showing correction data D in a case where variations in the amounts of discharged ink droplets are small.

FIG. 16 shows the correction data D in a case where variations in the amounts of discharged ink droplets are small. In this case, the actuator drive voltage comes to have one kind, and even if correction is performed, an improvement is not made. Accordingly, in this case, the correction is not performed.

Incidentally, in the foregoing description, although the system of dividing the actuator drive voltage has been described, no limitation is made to this mode, and a system of dividing the print dot diameter may be adopted.

FOURTH EMBODIMENT

In the fourth embodiment, the same portions as those of the first embodiment are denoted by the same symbols and their description will be omitted.

In the method described in the first embodiment, when the respective actuator drive voltages are adjusted in accordance with the correction data D and the ink droplet amounts are corrected, in the case printing is continuously performed at the same position of the recording medium 16, the actuator at the portion generates heat and the ink droplet amount becomes large. As a result, local unevenness occurs in the corrected ink droplet amount. In the fourth embodiment, a method of correcting the local unevenness generated by such heat generation will be described.

The local heat generation portion is detected, and correction data D is rewritten correspondingly to the portion. As a method of detecting the local heat generation portion, for example, when image formation is performed, a portion of the actuator driven so as to continuously discharge ink has only to be detected.

Figure 17:
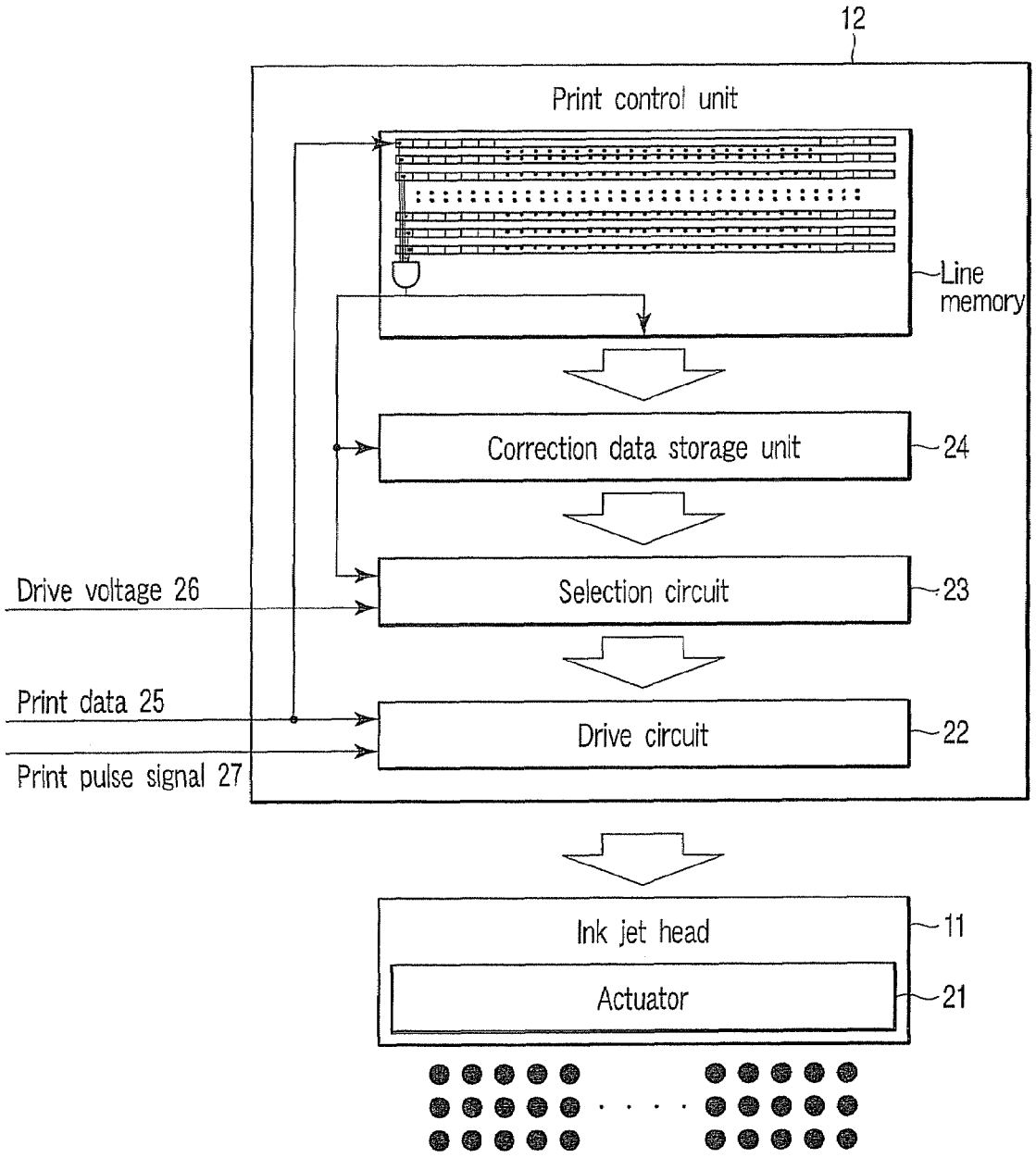
FIG. 17 is a view for explaining a method of detecting local heat generation.

FIG. 17 is a view for explaining the method of detecting the local heat generation.

A print control unit 12 is newly provided with a line memory. Print data 25 is inputted to a driving circuit 22 and is also inputted to the line memory. The print data 25 for the past n lines is stored in the line memory. With respect to the print data 25 for the n lines, n data corresponding to each actuator position are subjected to an AND operation. The operation result is made a temperature correction signal for correcting influence due to temperature. The correction data D of each actuator is adjusted based on the temperature correction signal. For example, when the temperature correction signal becomes ON, since printing is continuously performed for the n lines, an adjustment is made so that the correction data D becomes a voltage lower by one level.

In the foregoing description, a portion where image data is continuous is detected, and the correction voltage of the portion is adjusted, however, the invention is not limited to this embodiment. As shown in FIG. 10, an increase in ink droplet due to a temperature rise may be detected from an image photographed by the CCD camera attached to the printing apparatus.

FIFTH EMBODIMENT

In a fifth embodiment, the same portions as those of the first embodiment are denoted by the same symbols and their description will be omitted.

In the method as described in the first embodiment, when the ink droplet amount is corrected by adjusting the respective actuator drive voltages in accordance with the correction data D, a minute density difference occurs in a changing portion of the corrected actuator drive voltage.

Figure 18:
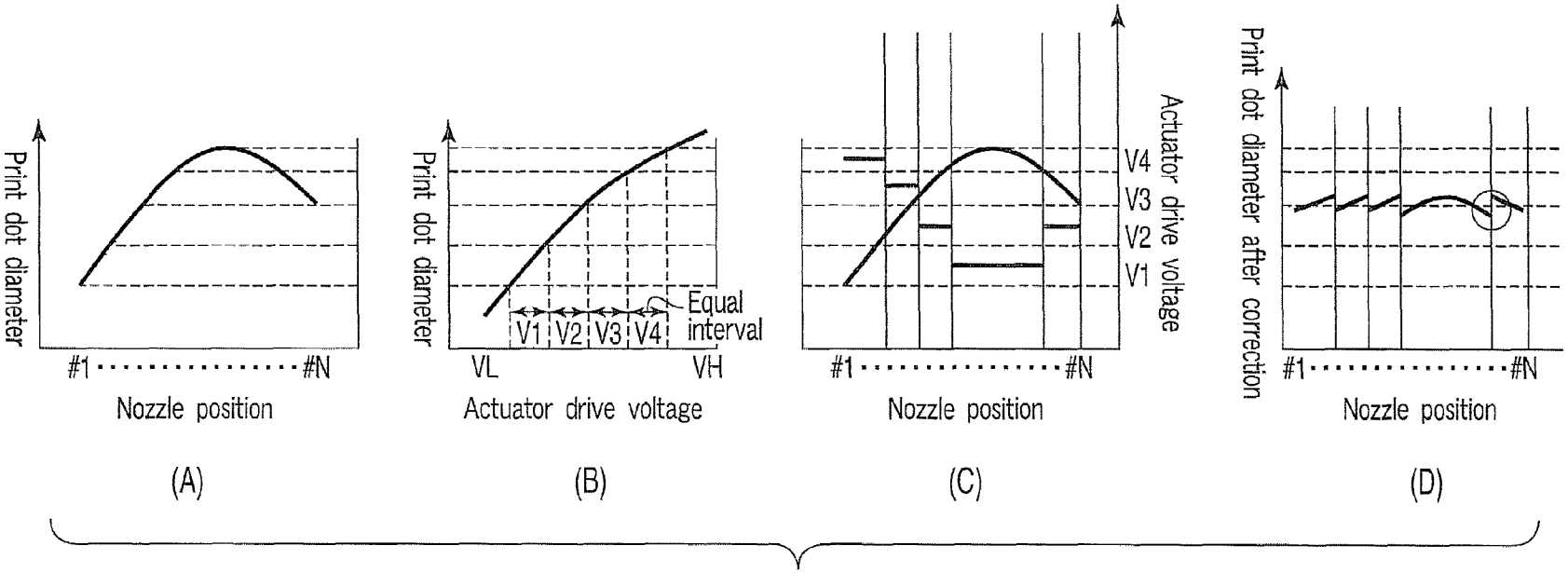
FIG. 18 is a view for explaining the occurrence of minute density difference.

FIG. 18 is a view for explaining the occurrence of the minute density difference. Since FIG. 18(A), FIG. 18(B) and FIG. 18(C) are the same as FIG. 5, their description will be omitted.

Figure 19:
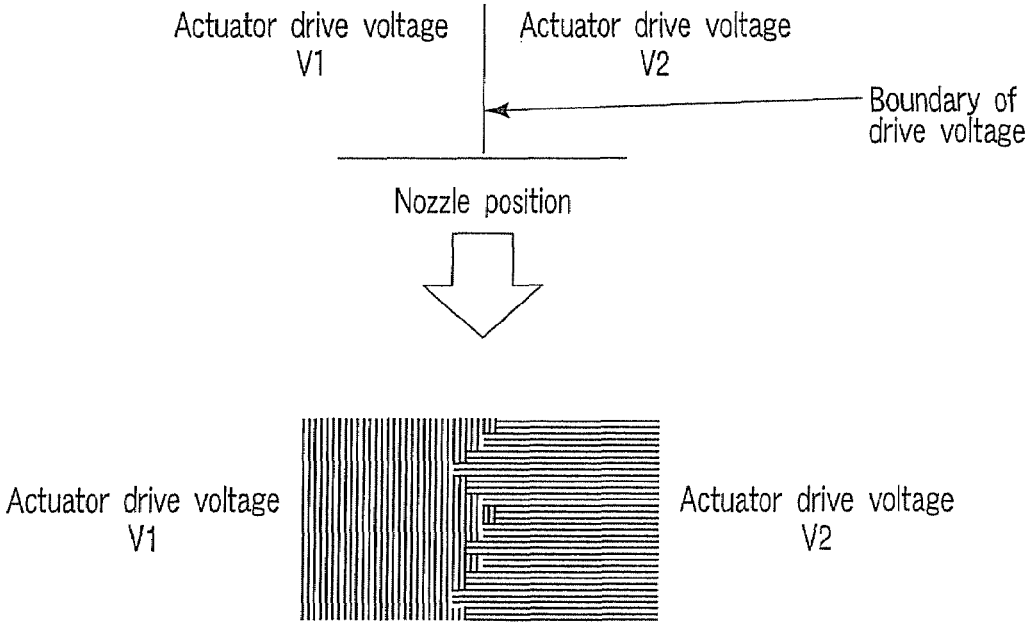
FIG. 19 is a view for explaining a method of eliminating minute density difference occurring in a changed portion of actuator drive voltage.

FIG. 18(D) shows diameters of print dots printed as a result of image formation in which actuator drive voltages V1-V4 of FIG. 18(C) are used and ink droplets are made to fly. As compared with FIG. 18(A), variations in the nozzles can be suppressed to be small with respect to the whole head. However, in the voltage changing portion, the ink droplet correction is not satisfactory, and a stepped portion (density difference) occurs. In FIG. 19, a circle portion of FIG. 18(D) is enlarged and shown.

FIG. 19 is a view for explaining a method of eliminating the minute density difference occurring in the changing portion of the actuator drive voltage.

The boundary position of actuators is moved horizontally so that the actuator of the boundary portion is not corrected continuously with the same correction voltage, that is, the boundary portion does not become continuous. As stated above, the correction data D is changed each time one line is printed, and the continuity at the boundary portion where the actuator drive voltage is changed is eliminated, so that the density difference does not become noticeable, and the correction accuracy can be improved.

Incidentally, in an edge portion of an image, a phenomenon in which the end becomes dense occurs due to the occurrence of cross-talk, not due to the change of the actuator drive voltage. Also in this case, when the edge portion is moved horizontally, the density difference can be made not noticeable.

Besides, according to this system, for example, correction of the amount of ink droplet discharged from the ink jet head 11 using a multi-drop system and capable of performing gradation printing can be performed similarly.

SIXTH EMBODIMENT

In a sixth embodiment, the same portions as those of the first embodiment are denoted by the same symbols and their detailed description will be omitted.

In the sixth embodiment, a driving method of a long ink jet head will be described. In the case where correction is performed over the whole long ink jet head by the method described in the first embodiment, the correction accuracy of the discharge variation is reduced. This is because in the long ink jet head 11, not only the working accuracy thereof, but also variations in the material itself can not be neglected, and for example, variations in the maximum value and the minimum value of the amounts of discharged ink droplets become large as compared with the short head.

Figure 20:
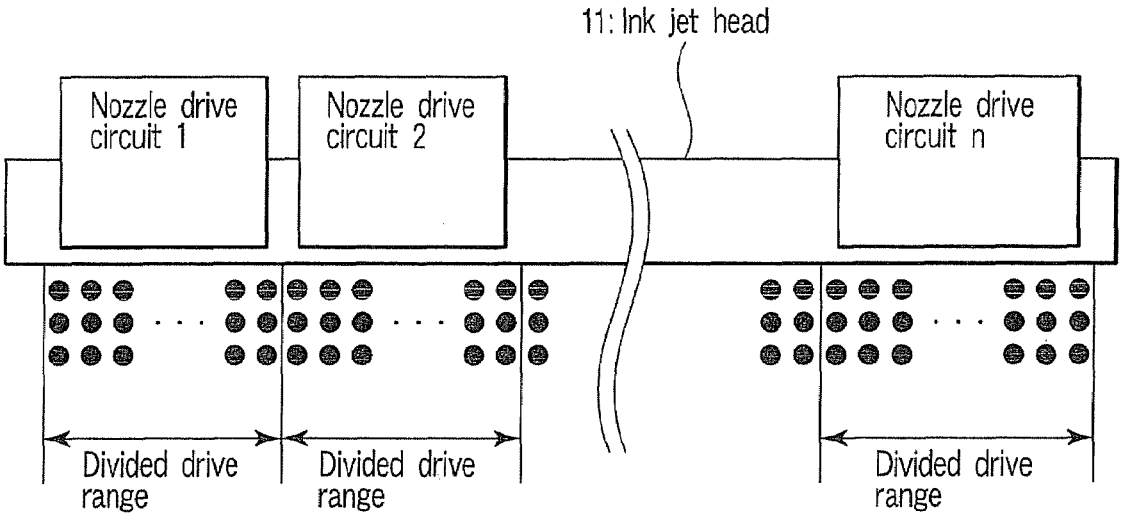
FIG. 20 is a view for explaining a method of driving a long ink jet head.

FIG. 20 is a view for explaining a method of driving the long ink jet head.

The driving range of the long ink jet head is divided into plural parts, and correction is performed so that the ink droplet amounts become uniform in each of the divided ranges. In this case, a combination may be made with the method of the second embodiment in which the D/A converter 71 is included, or the method of the third embodiment in which when the driving range is grouped, the adjustment can be performed in the range wider than the grouping number. The high accuracy correction becomes possible by combining these methods with the long ink jet head. Incidentally, since the details of the correction have been described in the second embodiment and the third embodiment, the duplicate description will be omitted.

SEVENTH EMBODIMENT

In a seventh embodiment, the same portions as those of the first embodiment are denoted by the same symbols and their description will be omitted.

In the seventh embodiment, correction data D is stored in an ink jet head 11. The correction data D is read out from the ink jet head 11 and is stored in a correction data storage unit 24.

Figure 21:
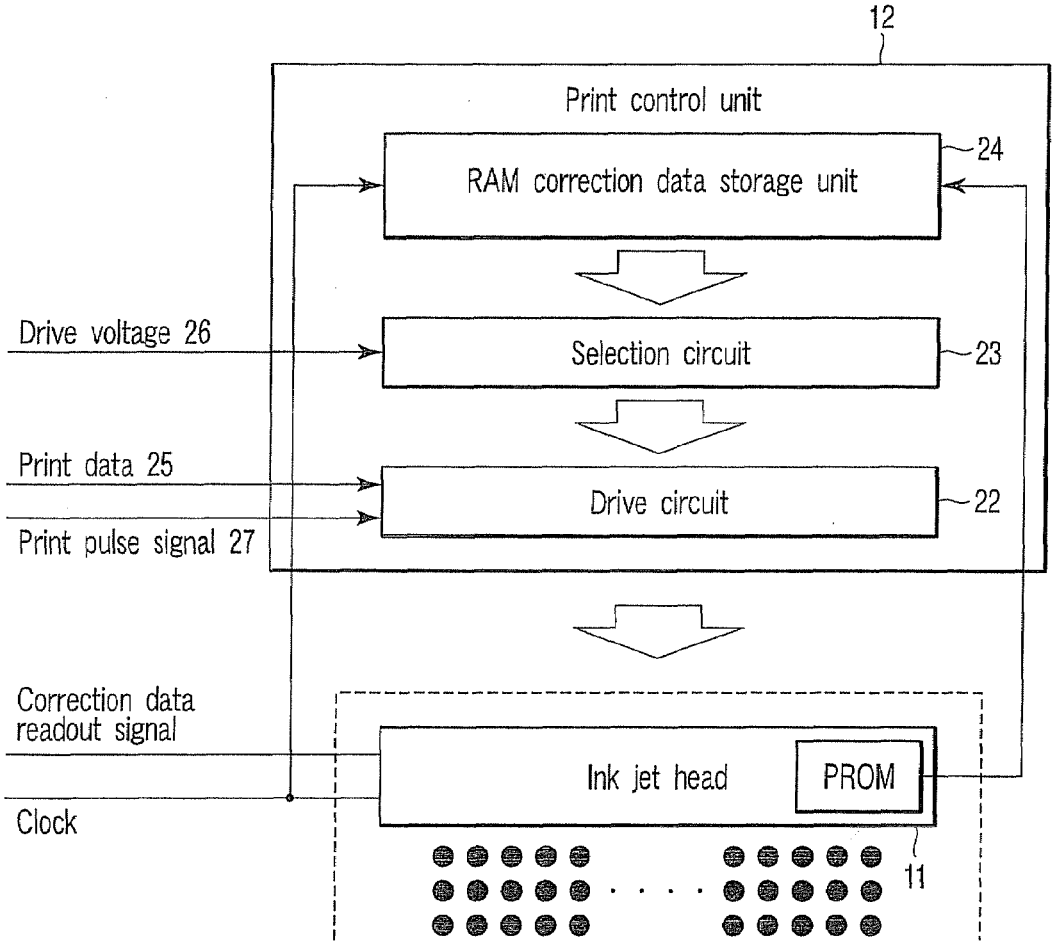
FIG. 21 is a view showing a structure of an ink jet head driving circuit.

FIG. 21 is a view showing a structure of an ink jet head driving circuit of a print control unit 12 according to the seventh embodiment.

In the ink jet head 11, a broken line portion is a connector and can be detached. The correction data D is written in the ink jet head 11. For example, a PROM (Programmable Read-Only Memory) is used, and the correction data is written at the time point of manufacture. With respect to the creation of the correction data D, the method described in the first embodiment is used. Besides, the correction data storage unit 24 includes a RAM (Random Access Memory).

Figure 22:
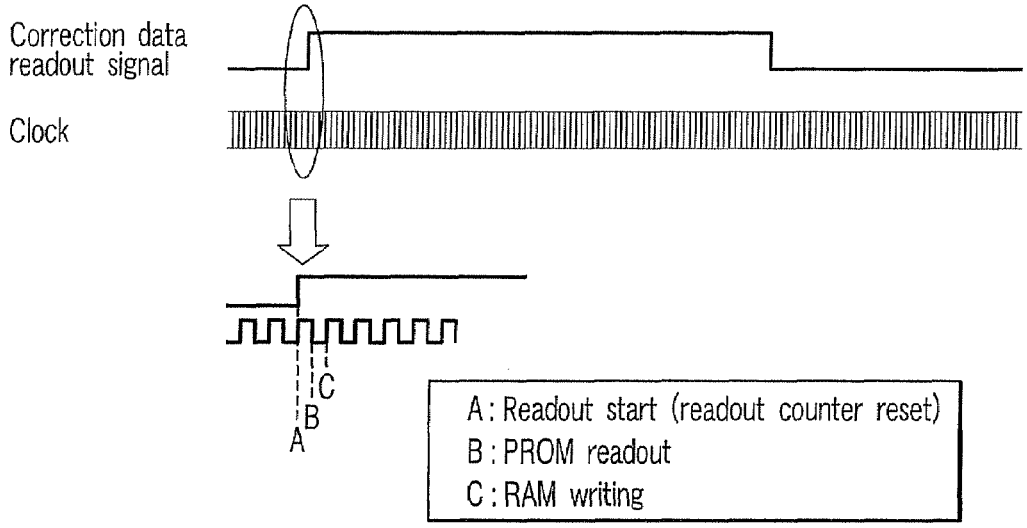
FIG. 22 is a view showing readout timing.

The readout operation of the correction data D will be described. FIG. 22 is a view showing readout timing. A correction data readout signal rises at the time of turning on power, and a readout mode occurs. Next, the correction data D is read out from the PROM in synchronization with a clock, and is directly written into the correction data storage unit 24. Incidentally, necessary data is included in the correction data D correspondingly to the foregoing respective embodiments. For example, in the case where the D/A converter 71 of the second embodiment is used, the designation data S is included in the correction data D.

EIGHTH EMBODIMENT

An eighth embodiment is different from the first embodiment in that the amount of an ink droplet is controlled with the width of a drive pulse. Accordingly, in the eighth embodiment, the same portions as those of the first embodiment are denoted by the same symbols and their detailed description will be omitted.

Figure 23:
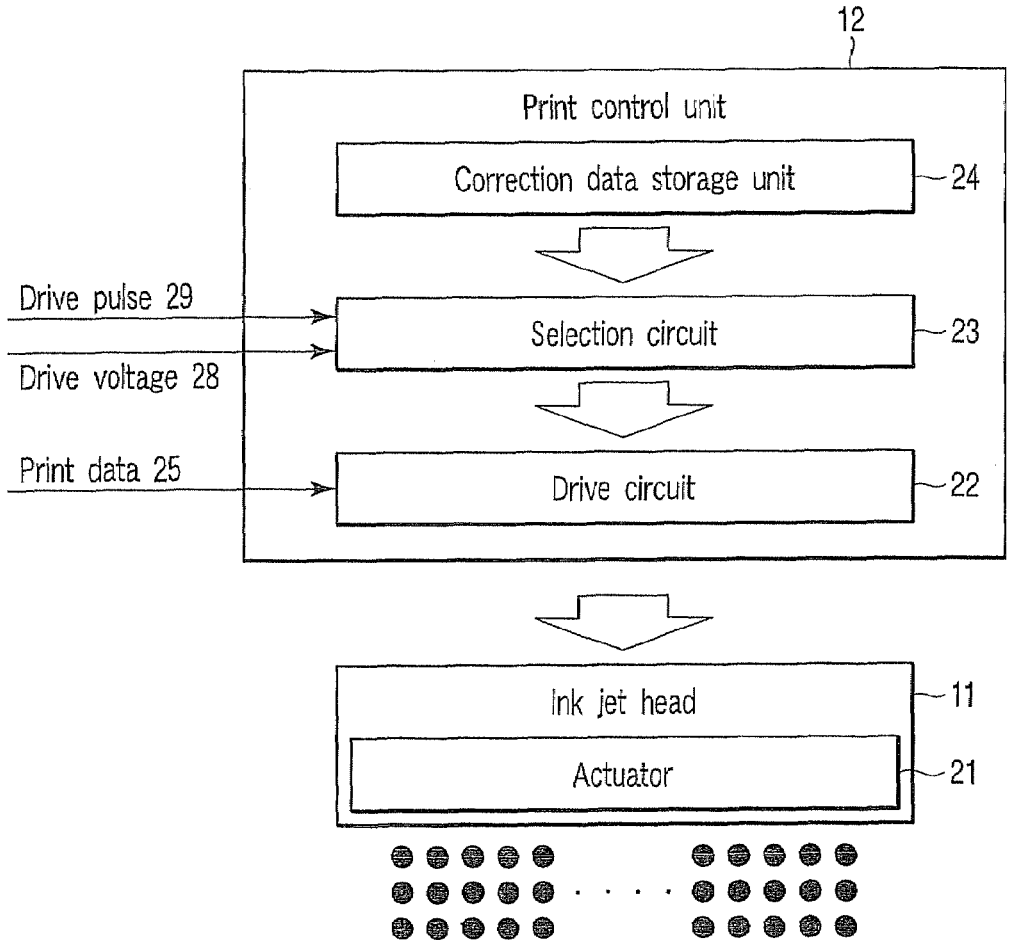
FIG. 23 is a view showing a structure of an ink jet head driving circuit.

FIG. 23 is a view showing a structure of an ink jet head driving circuit of a print control unit 12.

An ink jet head 11 includes actuators 21. The actuators 21 are provided to correspond to respective nozzles of the ink jet head 11, and the number N thereof is equal to the number N of the nozzles. The actuator 21 is driven so that the amount of a droplet discharged from the nozzle is controlled.

The print control unit 12 includes a driving circuit 22, a selection circuit 23, and a correction data storage unit 24. The driving circuit 22 drives the actuator 21 of the ink jet head 11. The correction data storage unit 24 stores correction data D for the respective actuators.

Various signals for controlling the printing are inputted to the respective units of the print control unit 12. Drive voltages 28 and drive voltage pulses 29 are inputted to the selection circuit 23. Print data 25 is inputted to the driving circuit 22.

The drive voltages 28 are the voltages for driving the actuators 21 of the ink jet head 11. The drive voltage pulses 29 are m kinds (P1-Pm) of pulse signals for driving the actuators 21 of the ink jet head 11. The actuators 21 of the ink jet head 11 are driven with the drive voltages 28 having the drive pulse widths. The print data 25 is the data for driving the actuators 21 of the ink jet head 11 to discharge ink.

The correction data D corresponding to the respective actuators 21 of the ink jet head 11 stored in the correction data storage unit 24 is read out and is supplied to the selection circuit 23. In the selection circuit 23, in accordance with the correction data D of the respective actuators 21, one pulse signal is selected from P1-Pm of the drive pulses 29. The selected pulse signal is supplied to the actuator 21 at the timing of the print pulse signal 27.

Figure 24:
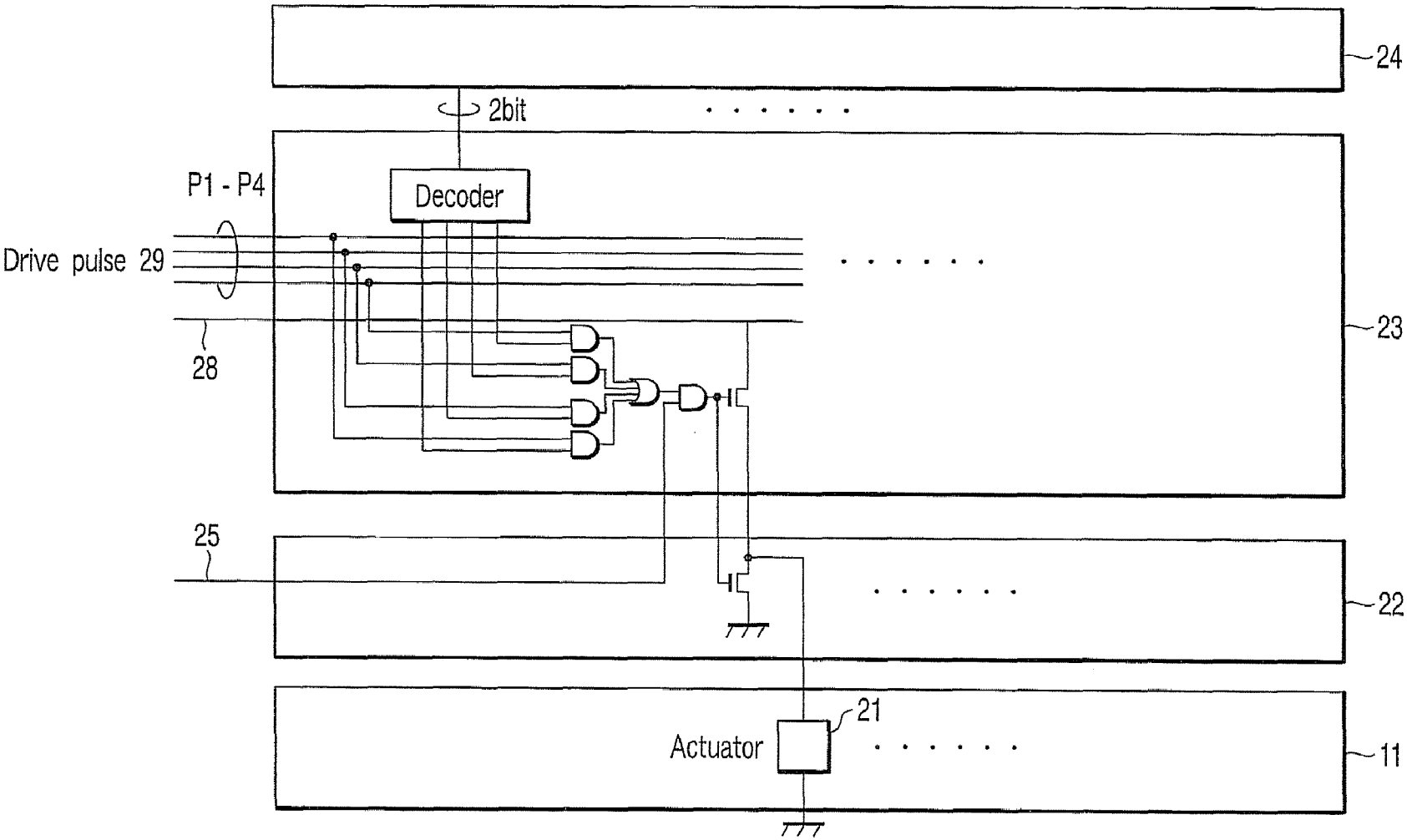
FIG. 24 is a view showing a detailed structure of the ink jet head driving circuit.

FIG. 24 shows a detailed structure of an ink jet head driving circuit. The n actuators 21, the n driving circuits 22, the n selection circuits 23 and the n correction data storage units 24 are prepared, where n is equal to the number of actuators. FIG. 24 shows a circuit portion for one actuator.

The correction data D of 2-bit information of the actuator 21 is stored in the correction data storage unit 24. The 2-bit information is read out from the correction data storage unit 24, is supplied to the selection circuit 23 and is inputted to the decoder. Only one of four selection signals S11-S14 outputted from the decoder becomes "H" in accordance with the correction data D.

The actuator drive pulses 29 and the four selection signals S11-S14 outputted from the decoder are inputted to an AND circuit. Thus, with respect to the actuator drive pulses 29, only one pulse width is selected therefrom.

The print data 25 serially transmitted from the outside is decomposed into print data of the respective actuators 21 by a shift register (not shown) of the driving circuit 22. The selected drive pulse 29 and the print data 25 decomposed into the data of the respective actuators 21 are connected to a switching element through an AND circuit in the selection circuit 23. This switching element is connected so as to select the drive voltage 28 supplied from the outside of the selection circuit 23.

As a result, the drive voltage 28 having the width of the drive pulse selected with the correction data D and by the decoder is supplied to the driving circuit 22. The supplied voltage is directly supplied to the actuator 21 and is also simultaneously supplied to a discharge circuit. In this way, according to the ink jet head driving circuit, the drive pulse width can be selectively changed in accordance with the correction data D.

Next, a creation method of the correction data D will be described.

The correction data D is obtained correspondingly to the ink discharge amount at the time when the actuator 21 of the ink jet head 11 is driven. As a method of obtaining the ink discharge amount, there is a method using a print dot diameter at the time when an image is formed with single dots on a recording medium 16, a line width of an image at the time when the image is formed with continuous dots by scanning the recording medium 16 and the ink jet head 11 relatively, volume calculation by an image pickup and image processing of an ink droplet discharged from the ink jet head 11 or the like. Hereinafter, the method of obtaining the correction amount in accordance with the dot diameter will be described as an example.

Figure 25:
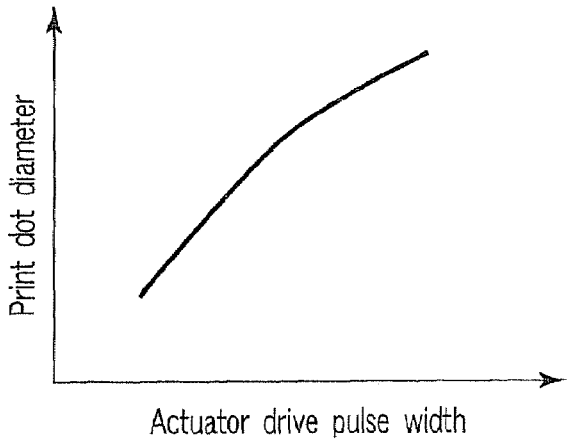
FIG. 25 is a view showing a relation between a print dot diameter and an actuator drive pulse width.

FIG. 25 shows a relation between a print dot diameter and an actuator drive pulse width. As the pulse width becomes wide, the amount of a discharged ink droplet becomes large, and as a result, the print dot diameter becomes large.

Figure 26:
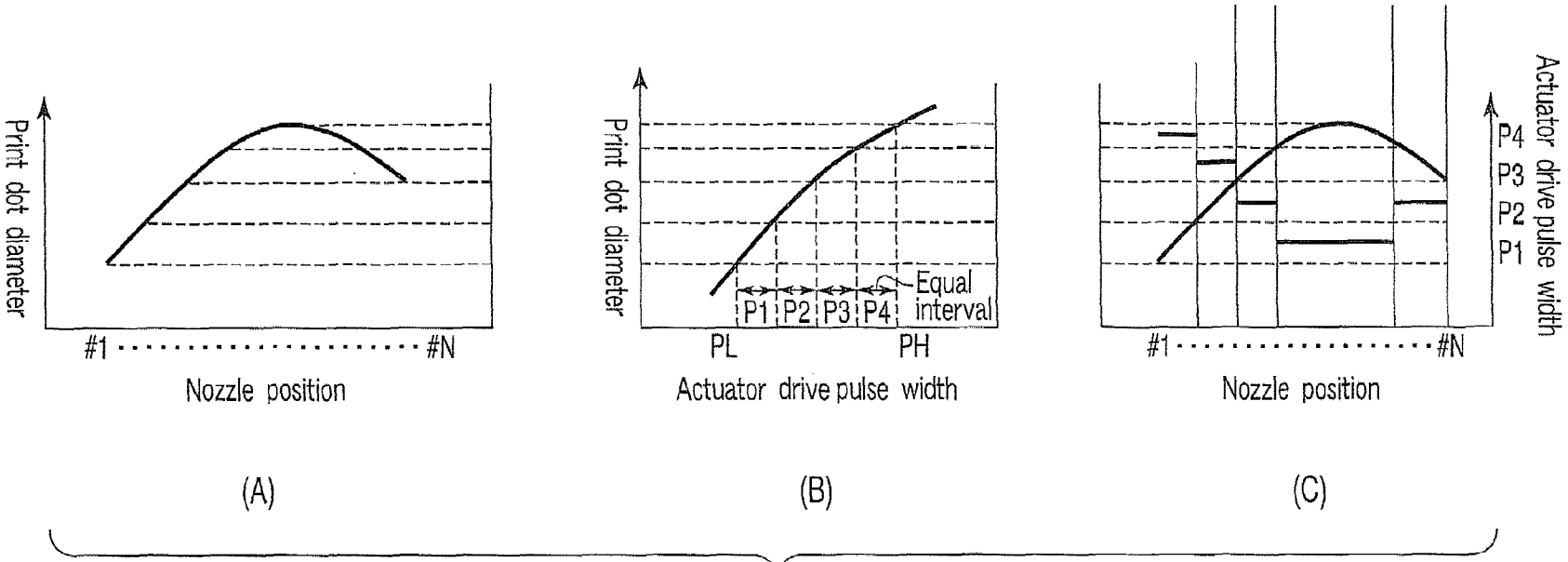
FIG. 26 is a view for explaining a creation method of correction data.

FIG. 26(A) shows measurement results of print dot diameters corresponding to nozzle positions of the ink jet head 11. This drawing shows an example in which all the actuators 21 of the ink jet head 11 are driven to form an image and the dot diameters are measured.

Next, the maximum value and the minimum value of the dot diameter actual measurement results are obtained, and they are divided into groups. With respect to the number of the groups at this time, since the correction data D explained in FIG. 3 has 2 bits, the division into four parts is performed.

In FIG. 26(B), the relation between the print dot diameter and the actuator drive pulse width explained in FIG. 25 is arranged next to FIG. 26(A) and is made to correspond thereto. An actuator drive pulse width PH of a portion where the print dot diameter becomes the maximum value and an actuator drive pulse width PL of a portion where the print dot diameter becomes the minimum value are obtained. The range of (PH-PL) is divided into four equal parts and is divided into four groups. The center pulse widths of the respective groups are set to be P1, P2, P3 and P4 in ascending order.

Based on the measurement result of the print dot diameter, an actuator drive pulse width is determined from the grouped pulse widths P1-P4. A portion belonging to a group in which the print dot diameter is large is given the actuator drive pulse width P1, and a portion belonging to a group where the print dot diameter is small is given the actuator drive pulse width P4. FIG. 26(C) shows the relation between the nozzle position and the actuator drive pulse width.

As a result, the correction data D is stored in the correction data storage unit 24 such that it is "00"B when the actuator drive pulse width is P1, "01"B when the actuator drive pulse width is P2, "10"B when the actuator drive pulse width is P3, and "11"B when the actuator drive pulse width is P4, and the actuator 21 is driven in accordance with this.

NINTH EMBODIMENT

In a ninth embodiment, the same portions as those of the first embodiment are denoted by the same symbols and their description will be omitted.

Figure 27:
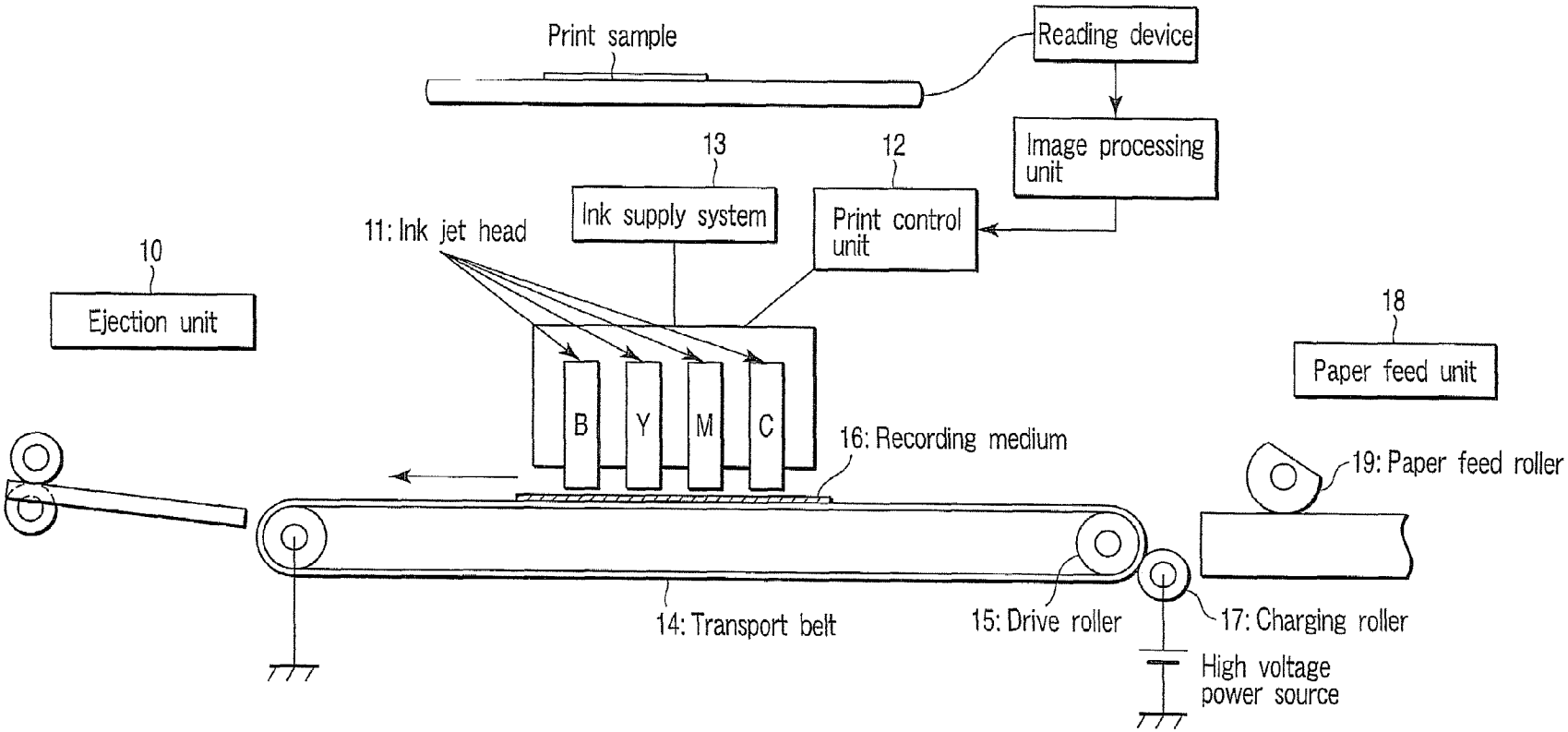
FIG. 27 is a view showing a printing apparatus in which an image of printing result is captured by a scanner and dot diameters are measured.

FIG. 27 shows a printing apparatus in which an image of a print result is captured by a scanner and its dot diameter is measured. The printing apparatus includes a reading device for reading an image.

The user causes a specified pattern for generating correction data D to be recorded on a recording medium 16. The recorded recording medium 16 is set on the reading device, and an operation of reading the printed pattern is performed by the scanner. The image read by the reading device is supplied to an image processing unit. The image processing unit performs a correction such as a shading correction, and binarizes the image. Based on the image processing result, the image processing unit measures dot diameters formed by ink droplets discharged from the respective actuators. The dot diameters of the measurement results are supplied to a print control unit 12. The print control unit 12 creates correction data D and adjusts the actuator drive voltage.

Incidentally, the specified pattern to be printed is not limited to one expressing the dot diameter, but may be one expressing the line width of a straight line, or may be a combination of these.

Although the respective embodiments of the invention have been described, the system of the ink jet head may be any of a Piezo system, a thermal system, and an electrostatic system.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet head driving apparatus for driving an ink jet head having plural nozzles to discharge supplied ink, comprising:

actuators provided corresponding to the respective nozzles which are classified into plural groups corresponding to ink discharge amount characteristics of the nozzles, and to cause corresponding amounts of ink to be discharged from the nozzles by drive signals;

a storage unit configured to store correction data which is determined for each of the plural classified groups of nozzles, for equalizing the ink discharge amounts from the respective nozzles;

a selection unit configured to select one drive signal from plural drive signals based on the correction data; and a group boundary position change unit configured to change the actuator at a boundary position of the groups by print line.

2. The ink jet head driving apparatus according to claim 1, wherein a range between a maximum value and a minimum value of the ink discharge amounts of the nozzles is divided into plural groups to obtain drive signals corresponding to ink discharge amounts of the respective groups, and the correction data is determined so that a drive signal which produces a small amount of ink discharge is reset for a group to give a large ink discharge amount, and a drive signal which produces a large amount of ink discharge is reset for a group to give a small ink discharge amount.

3. The ink jet head driving apparatus according to claim 2, wherein the drive signals are signals to make voltages variable or signals to make pulse widths variable.

4. The ink jet head driving apparatus according to claim 2, wherein the ink discharge amounts are obtained by processing an image recorded on a recording medium.

5. The ink jet head driving apparatus according to claim 2, further comprising a correction data change unit configured to, in a case where the actuator operates continuously for past specified lines, change the corresponding correction data to decrease the ink discharge amount of the actuator.

6. The ink jet head driving apparatus according to claim 2, wherein the plural groups equally divide the range between the maximum value and the minimum value of the ink discharge amounts.

7. The ink jet head driving apparatus according to claim 2, wherein the plural groups equally divide a range of the drive signals to give the maximum value and the minimum value of the ink discharge amounts.

8. A nozzle driving device for driving nozzles in each of plural blocks obtained by dividing an ink jet head having plural nozzles to discharge supplied ink, comprising:

actuators provided corresponding to the respective nozzles which are classified into plural groups corresponding to ink discharge amount characteristics of the nozzles, and to cause corresponding amounts of ink to be discharged from the nozzles by drive signals;

a storage unit configured to store correction data which is determined for each of the plural classified groups of nozzles, for the respective blocks and for equalizing the ink discharge amounts from the respective nozzles;

a selection unit configured to select one drive signal from plural drive signals based on the correction data; and a group boundary position change unit configured to change the actuator at a boundary position of the groups by print line.

9. The nozzle driving device according to claim 8, wherein a range between a maximum value and a minimum value of the ink discharge amounts of the nozzles is divided into plural groups to obtain drive signals corresponding to ink discharge amounts of the respective groups, and the correction data is determined so that a drive signal which produces a small amount of ink discharge is reset for a group to give a large ink discharge amount, and a drive signal which produces a large amount of ink discharge is reset for a group to give a small ink discharge amount.

10. An ink jet head driving method for an ink jet head driving apparatus including an ink jet head having plural nozzles of the ink jet head, the method comprising:

classifying the nozzles of the ink jet head into plural groups corresponding to ink discharge amount characteristics of the nozzles;

determining, for the respective plural groups of the nozzles, stored correction data for equalizing the ink discharge amounts from the respective nozzles;

selecting one drive signal from the plural drive signals based on the correction data;

changing the actuator at a boundary position of the groups by print line; and outputting the selected drive signal to the actuator at a specified timing.

11. The ink jet head driving method according to claim 10, wherein a range between a maximum value and a minimum value of the ink discharge amounts of the nozzles is divided into plural groups to obtain drive signals corresponding to ink discharge amounts of the respective groups, and the correction data is determined so that a drive signal which produces a small amount of ink discharge is reset for a group to give a large ink discharge amount, and a drive signal which produces a large amount of ink discharge is reset for a group to give a small ink discharge amount.

12. The ink jet head driving method according to claim 11, wherein the drive signals are signals to make voltages variable or signals to make pulse widths variable.

13. The ink jet head driving method according to claim 11, wherein the ink discharge amounts are obtained by processing an image recorded on a recording medium.

14. The ink jet head driving method according to claim 11, wherein in a case where the actuator operates continuously for past specified lines, the corresponding correction data is changed to decrease the ink discharge amount of the actuator.

15. The ink jet head driving method according to claim 11, wherein the plural groups equally divide the range between the maximum value and the minimum value of the ink discharge amounts.

16. The ink jet head driving method according to claim 11, wherein the plural groups equally divide a range of the drive signals to give the maximum value and the minimum value of the ink discharge amounts.

* * * * *